US008029377B2

(12) United States Patent
Velderman et al.

(10) Patent No.: US 8,029,377 B2
(45) Date of Patent: Oct. 4, 2011

(54) CHILD MOTION DEVICE

(75) Inventors: Matthew Velderman, Westfield, NJ (US); William B. Bellows, Wyomissing, PA (US); Joshua E. Clapper, Exeter, PA (US); Matthew J. Ransil, Richland, PA (US); James E. Godiska, Exton, PA (US); Baku Kakuda, Reading, PA (US)

(73) Assignee: Graco Children's Products Inc., Exton, PA (US)

( * ) Notice: Subject to any disclaimer, the term of this patent is extended or adjusted under 35 U.S.C. 154(b) by 475 days.

(21) Appl. No.: 12/051,468

(22) Filed: Mar. 19, 2008

(65) Prior Publication Data

US 2008/0217974 A1 Sep. 11, 2008

Related U.S. Application Data

(63) Continuation-in-part of application No. 11/385,260, filed on Mar. 20, 2006, now Pat. No. 7,563,170.

(60) Provisional application No. 60/895,620, filed on Mar. 19, 2007, provisional application No. 60/732,640, filed on Nov. 3, 2005.

(51) Int. Cl.
*A63G 9/16* (2006.01)
*A63G 9/00* (2006.01)

(52) U.S. Cl. ..... 472/119; 5/108

(58) Field of Classification Search ..... 472/118–125; 5/108–109; 297/273, 274, 284
See application file for complete search history.

(56) References Cited

U.S. PATENT DOCUMENTS

| | | | |
|---|---|---|---|
| 43,972 | A | 8/1864 | Coldwell |
| 100,083 | A | 2/1870 | Stephan |
| 616,697 | A | 12/1898 | Cowles et al. |
| 2,506,890 | A | 5/1950 | Pratt |
| 2,704,111 | A | 3/1955 | Wunderlich |
| 3,147,972 | A | 9/1964 | Borsuk |
| 4,226,467 | A | 10/1980 | Boudreau |
| 4,258,446 | A | 3/1981 | McAllister |
| 4,620,334 | A | 11/1986 | Robinson |
| 4,805,902 | A | 2/1989 | Casagrande |
| 4,911,499 | A | 3/1990 | Meeker |
| 4,978,120 | A | 12/1990 | Greenwood |

(Continued)

FOREIGN PATENT DOCUMENTS

DE 24 21 474 11/1975

(Continued)

OTHER PUBLICATIONS

International Search Report and Written Opinion issued in related International application No. PCT/US2008/057495 mailed Jun. 4, 2008.

(Continued)

*Primary Examiner* — Kien T Nguyen
(74) *Attorney, Agent, or Firm* — Lempia Summerfield Katz LLC

(57) ABSTRACT

A child motion device includes a frame that provides a structural support relative to a reference surface and that includes an arm pivotably coupled to the structural support. A child supporting device is coupled to the arm and spaced from the reference surface by the frame. A drive system is configured to move the arm such that the child supporting device reciprocates along a motion path at a frequency within a range from about 0.37 Hz to about 0.62 Hz. In some cases, a further drive system is configured to oscillate the child supporting device generally along the axis of rotation at a frequency in a range from about 2.85 Hz to about 3.15 Hz.

38 Claims, 20 Drawing Sheets

U.S. PATENT DOCUMENTS

| | | | |
|---|---|---|---|
| 5,303,433 | A | 4/1994 | Jang |
| 5,403,239 | A | 4/1995 | Zimmers |
| 5,525,113 | A | 6/1996 | Mitchell et al. |
| 5,688,211 | A | 11/1997 | Myers |
| 5,803,817 | A | 9/1998 | Stern |
| 6,027,409 | A | 2/2000 | Favorito et al. |
| 6,339,304 | B1 | 1/2002 | Allison et al. |
| 6,343,994 | B1 | 2/2002 | Clarke |
| 6,574,806 | B1 | 6/2003 | Maher |
| 6,811,217 | B2 | 11/2004 | Kane et al. |
| 6,854,799 | B1 | 2/2005 | Asbach et al. |
| 6,872,146 | B1 | 3/2005 | Paesang et al. |
| 6,875,117 | B2 | 4/2005 | Ransil et al. |
| 2002/0113469 | A1 | 8/2002 | Stern et al. |
| 2005/0091743 | A1 | 5/2005 | Bloemer et al. |
| 2005/0101219 | A1 | 5/2005 | Paesang et al. |
| 2005/0283908 | A1 | 12/2005 | Wong et al. |
| 2006/0012230 | A1 | 1/2006 | Kennedy |

FOREIGN PATENT DOCUMENTS

| | | |
|---|---|---|
| EP | 0 268 495 | 5/1988 |
| GB | 1 163 624 | 9/1969 |
| GB | 2 312 374 | 10/1997 |
| JP | 48-68367 | 9/1973 |
| JP | 60-14819 | 1/1985 |
| WO | WO 03/079861 | 10/2003 |
| WO | WO 2006/079859 | 8/2006 |
| WO | WO 2006/096712 | 9/2006 |

OTHER PUBLICATIONS

Fisher-Price Product Instruction Manual, Product No. N1973 (2007).

Fisher-Price Nature's Touch Baby Papasan Cradle Swing, Product #G2609, 2 pages, www.fisher-price.com (2006).

International Preliminary Report on Patentability issued in related International application No. PCT/US2008/057495 and mailed Jul. 10, 2009.

CHILD MOTION DEVICE

CROSS-REFERENCES TO RELATED APPLICATIONS

This application claims the benefit of U.S. provisional application Ser. No. 60/895,620, entitled "Child Motion Device" and filed Mar. 19, 2007, and is a continuation-in-part of U.S. non-provisional application Ser. No. 11/385,260, entitled "Child Motion Device" and filed Mar. 20, 2006, which, in turn, claims the benefit of U.S. provisional application Ser. No. 60/732,640, entitled "Child Swing" and filed Nov. 3, 2005, the entire disclosures of which are hereby expressly incorporated by reference.

BACKGROUND OF THE DISCLOSURE

1. Field of the Disclosure

The present disclosure is generally directed to child motion devices, and more particularly to child motion devices that impart swinging, bouncing, swaying, gliding or other motion to a child occupant.

2. Description of Related Art

Commercially available child motion devices include pendulum swings and infant bouncer seats. These types of devices are often used in an attempt to entertain, sooth or calm a child. At the outset, a child is typically placed in a seat of the device. With conventional child swings, the device then moves the seated child in a reciprocating, simple pendulum motion. The seat of a typical bouncer device is supported by a flexible wire frame. The child's own movement or an external force applied by a caregiver then results in the bouncing oscillation of the child.

Examples of child motion devices include a Fisher-Price pendulum swing with a motor above the child's head. The seat of the swing can be oriented in one of two optional seat facing directions by rotating the suspended pendulum-type swing arm through a 90 degree angle. Also, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. The seat of the swing moves in a manner such that a component of its travel path includes a side-to-side arcuate path shown in FIG. 9 of the patent. U.S. Pat. No. 6,343,994 discloses another child swing in which the base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

Despite the availability of various child motion devices, caregivers unfortunately often find the available devices to be unsatisfactory due to unsuccessful attempts to sooth a child.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
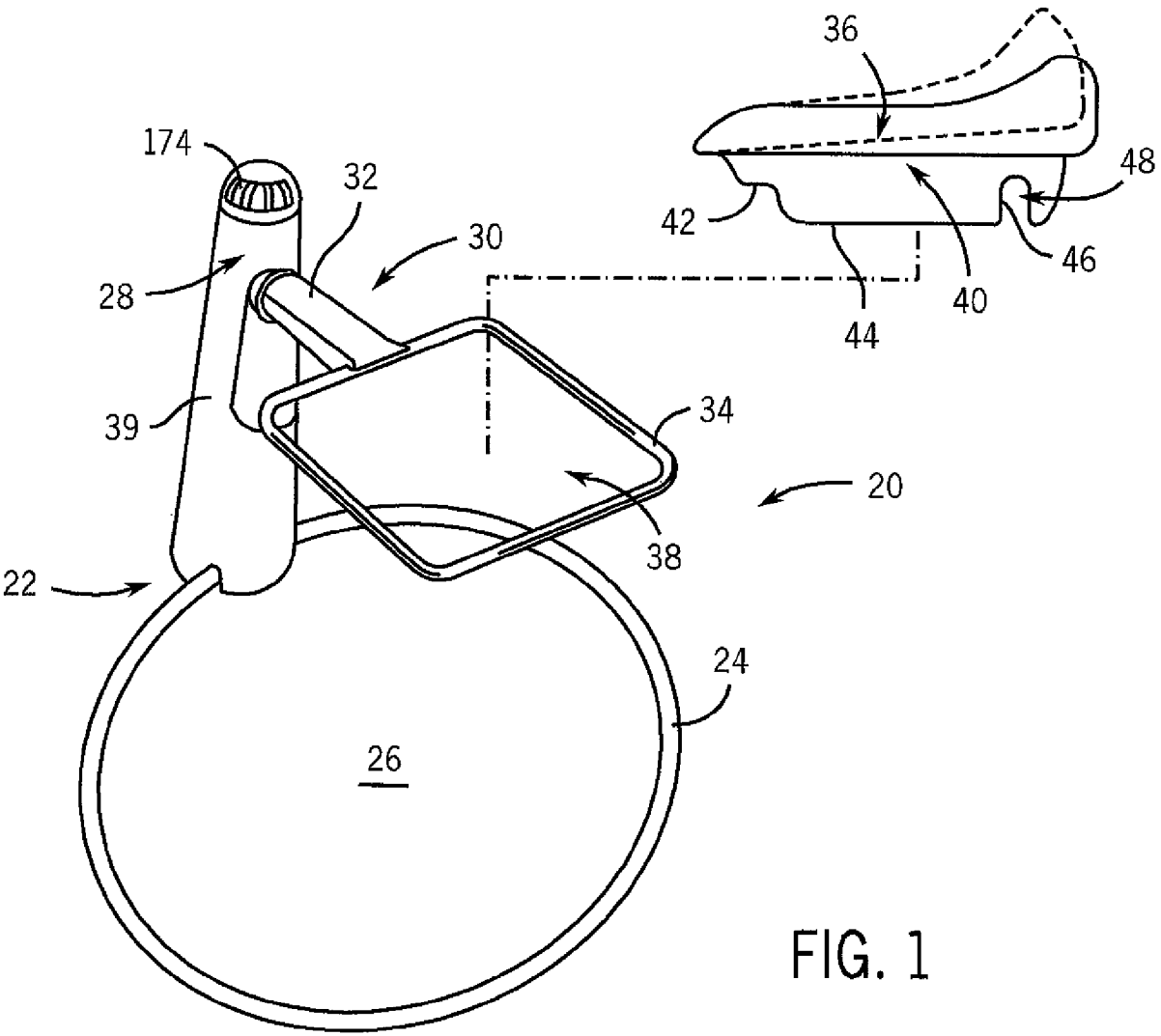
FIG. 1 is a perspective view of an exemplary child motion device with a seat in exploded view and constructed in accordance with one aspect of the disclosure.

Research has shown that many babies or children are not soothed or calmed by the motion provided by conventional child swings and bouncing seats. In contrast, children can still be readily calmed or soothed by motion imparted by a parent or caregiver holding the child. Caregivers often hold children in their arms and in front of their torso and move in a manner that is calming and/or soothing to the child. Such movements can include side-to-side rocking, light bouncing up and down, or light rotational swinging as the caregiver either swings their arms back and forth, rotates their torso from side-to-side, or moves in a manner combining these movements.

This disclosure is generally directed to motion devices constructed to mimic soothing movements provided to infant children by a caregiver. In some cases, the soothing motion involves a cradling sway motion path. Alternatively or additionally, the soothing motion incorporates a generally vertical bouncing movement, like the motion provided to a child resting at or near a shoulder of a caregiver. More generally, the disclosed child motion devices are generally based on the characteristics of the movements that parents typically use to soothe their children. The disclosed devices are thus configured to accurately mimic one or more characteristics of this motion. To these ends, the disclosed devices may be configured for operation with a variety of reciprocating motion paths at corresponding frequencies. For instance, the cradling sway motion path may involve reciprocating motion at a frequency within a first range of frequencies found to be characteristic of such parental soothing movements. The generally vertical bouncing movement may involve oscillating at a frequency within a second range of frequencies found to be characteristic of such movement when provided by a parent. As described below, these frequency ranges are supported by empirical motion data gathered from a statistically significant majority of a parent set monitored while soothing children.

In some embodiments, the child motion devices may be customizable or otherwise adjustable to allow a caregiver to select a motion path and a corresponding frequency that provides the most effective soothing. The operational setting selected by the caregiver may provide movement in accordance with one or both of the swaying and bouncing motions, and thus may involve one or both of the frequency ranges.

The disclosed devices generally exhibit motion or motion characteristics that mimic that of the parents. In some cases, the disclosed devices are configured to provide movement at statistically similar frequencies to those at which the majority of parents move their children. Instead of swing and bouncer products that move children outside of the optimal frequency windows described below, the disclosed devices are configured to deliver movement at a frequency (or frequencies) that correspond with the characteristics of the movement provided by parents.

Parents routinely soothe their children in two distinct techniques. The first motion technique involves a low frequency sway/swinging motion that is well represented or approximated by a normal distribution (i.e., a Bell curve) with a mean frequency around 0.5 Hz (0.4973 Hz) and a standard deviation of 0.1244 Hz. In one data set, the mean frequency was 0.48 Hz. The second motion technique involves a high-frequency bouncing motion with a principal frequency around 3.0 Hz with a standard deviation of 0.15 Hz. This empirical data identifies two primary motion frequency windows or ranges (i.e., about 0.37 Hz to about 0.62 Hz, and about 2.85 to about 3.15 Hz) as desired frequencies of operation for certain types of movement. The child motion devices described below are configured to provide the corresponding movement within each of these optimal frequency ranges.

In some aspects, the disclosure is generally directed to a complex sway motion path that makes it possible to achieve a desired motion frequency through the natural resonance of a system with reasonable device dimensions. For example, movement within the low frequency range may be provided via pendular movement with a generally vertical axis of rotation. To configure a device that operates within the low speed frequency range, a conventional (i.e., simple) pendulum swing would have a natural resonant frequency of 0.5 Hz by adjusting the pendulum arm length to 129 feet (simple pendulum natural frequency is calculated by: $\omega=\text{sqrt}(g/L)$). But this length may be inconveniently long for the typical full size infant swing. Other options include creating a direct drive swing motion mechanism that can drive the product at a frequency other than its natural frequency, as described below. This approach may, in some cases, require extremely high levels of energy. In other cases, and as described below, a complex sway motion path may involve an axis offset from vertical so that the movement includes both vertical and horizontal components. As a result, the device can have a more convenient pendulum arm length yet still move at its natural resonant frequency. In this way, the device relies on the natural resonance of the system and, thus, utilizes only limited power to overcome any damping.

The motion paths described herein also make it possible to provide smooth reciprocating movement. In some cases, the motion path includes both azimuthal and altitudinal changes, thereby using gravity as a smooth way to reverse direction in the swaying motion. The altitudinal changes may arise from the offset axis of rotation, which, acting alone, would result in a motion path lying within a plane tilted from horizontal. The altitudinal changes may also arise from the orientation of the pendulum arm with respect to the axis of rotation. In some cases, an acute angle for that orientation results in a cone-shaped path that may introduce further altitudinal changes along the motion path. With these types of altitudinal changes, undesirable higher frequency components are not introduced into the movement, leaving the motion profile (e.g., the frequency distribution of the movement) primarily at, or dominated by, the natural resonant frequency.

The terms generally, substantially, and the like as applied herein with respect to vertical or horizontal orientations of various components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Turning now to the drawings, FIG. 1 shows one example of a child motion device 20 constructed in accordance with the teachings of the present invention. The device 20 in this example generally includes a frame assembly 22 that has a base section 24 configured to rest on a floor surface 26. Throughout this detail description, the term "floor surface" is utilized to define both a surface on which the device rests when in the in-use configurations and a reference plane or surface for comparison to other aspects, parts or directions (e.g., vertical, horizontal, etc.) of the disclosure for ease of description. However, the invention is not intended to be limited to use with only a specifically floor-based or other horizontal orientation of either the base section of its frame assembly or the reference surface. Instead, the floor surface and the reference plane are utilized to assist in describing relationships between the various components of the device 20.

The child motion device 20 shown in FIG. 1 also has an upright riser, post, or spine 28 that extends upward from a part of the base section 24. In this example, the spine 28 is oriented in a generally vertical orientation relative to its longitudinal length. Any of the spines disclosed herein can have a housing or cover configured in any desired or suitable manner. The housing can be ornamental, functional, or both. The cover can also be removable to access the inner workings of the device if needed. The spine can vary considerably in orientation, shape, size, configuration, and the like from the examples disclosed herein.

In this example, a support arm 30 is cantilevered from the spine 28 and extends generally outward in a radial direction from the spine. In this example, the support arm 30 has a driven end 32 coupled to a portion of the spine 28. The support arm 30 is mounted for pivotal, side-to-side movement about its driven end through a travel path that is substantially horizontal. As described below, the support arm can travel through a partial orbit or arc segment of a predetermined angle and can rotate about an axis of rotation R (see, e.g., FIGS. 6A-6C). In some cases, and as described below, the axis of rotation may be offset from a vertical reference and which can be offset from an axis of the spine. Alternatively, the axis of rotation can be aligned with the vertical reference, the axis of the spine, or both if desired. As described below, the driven end is coupled to a drive system designed to reciprocate or oscillate the support arm. The support arm 30 in this example also has a distal end 33 with a seat holder 34 configured to support a child seat 36 for movement with the support arm.

The various components of the child motion device 20 shown in FIG. 1 and the various alternative embodiments of child motion devices described herein may vary considerably and yet fall within the spirit and scope of the present disclosure. A small number of examples are disclosed to illustrate the nature and variety of component configurations. In the example of FIG. 1, the base section 24 of the frame assembly 22 is in the form of a circular hoop sized to provide a stable base for the device 20 when in use. The configuration of the base section 24 can vary from the hoop shown in FIG. 1 as discussed later. The base section 24 is positioned generally beneath the seat holder 24 in order to offset the load or moment applied to the spine and created by a child placed in a seat of the cantilevered support arm. Similarly, the seat holder 34 can vary considerably and yet fall within the spirit and scope of the present invention. In this example, the seat holder 34 is a square or rectangular ring of material surrounding an opening 38. Other configurations and constructions of the seat holder 34 are also possible, and various alternative examples are illustrated herein. In this example, the spine 28 includes an external housing 39 that can be configured to provide a pleasing or desired aesthetic appearance. The housing 39 can also act as a protective cover for the internal components, such as the drive system, of the device 20.

In one example, the seat holder 34 is configured to permit the child seat 36 to be mounted on the support arm 30 in a number of optional orientations. As shown in FIG. 1, the child seat 36 may have a contoured bottom or base 40 with features configured to engage with portions of the seat holder 34 so that when it is rested on the seat holder, the child seat 36 is securely held in place. In this example, the seat holder is formed of tubular, linear side segments. The seat bottom has a flat region 42 on one end that rests on one linear side segment of the holder 34. A depending region 44 of the seat base 40 is sized to fit within the opening 38 of the holder. The other end of the base 40 has one or more aligned notches 46 that are configured to receive the opposite linear side segment of the holder. The depending region 44 and the notches 46 hold the child seat 36 in place on the holder. Gravity alone can be relied upon to retain the seat in position. In another example, one or more positive manual or automatic latches 48 may be employed in part of the seat, at one or both ends of the seat, as part of the seat holder 34, and/or at one or both ends of the seat holder to securely hold the child seat 36 in place on the seat holder 34. The latches 48 may be spring biased to automatically engage when the seat is placed on the holder.

Geometry and symmetry can be designed into the holder and seat to permit the seat to be placed in the holder in multiple optional seat orientations. As represented by dashed lines in FIG. 1, the seat and/or the seat holder can also be configured to permit the seat or holder incline to be adjusted to various recline angles. In another example, the holder and/or the seat can be cooperatively designed to permit the seat or other child supporting device to be rotated between fewer than four, more than four, or even an infinite number of seat facing orientations when placed on the holder. Cooperating discs on the two parts could be employed to achieve infinite orientation adjustment.

Figure 2:
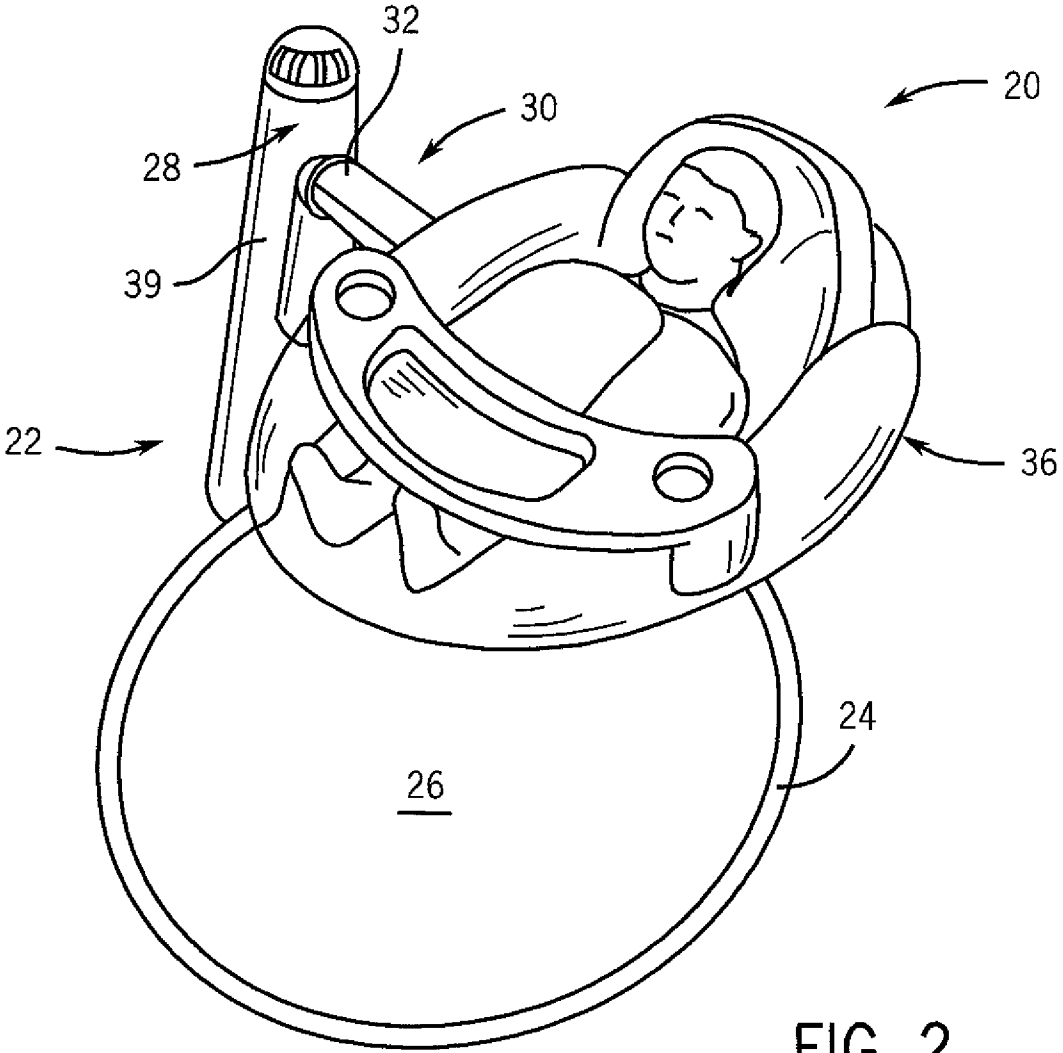
FIGS. 2-5 are perspective views of the child motion device shown in FIG. 1 with each view showing a child seat mounted in a different one of a plurality of optional seating orientations.
Figure 3:
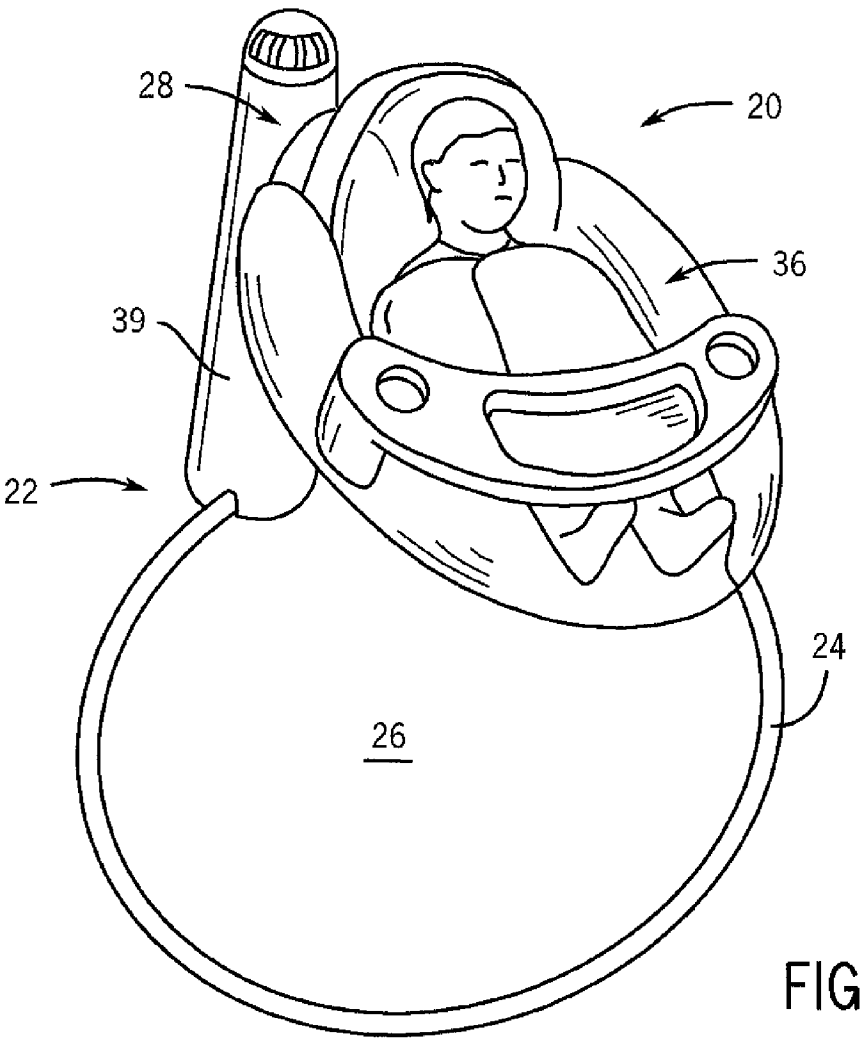
Figure 4:
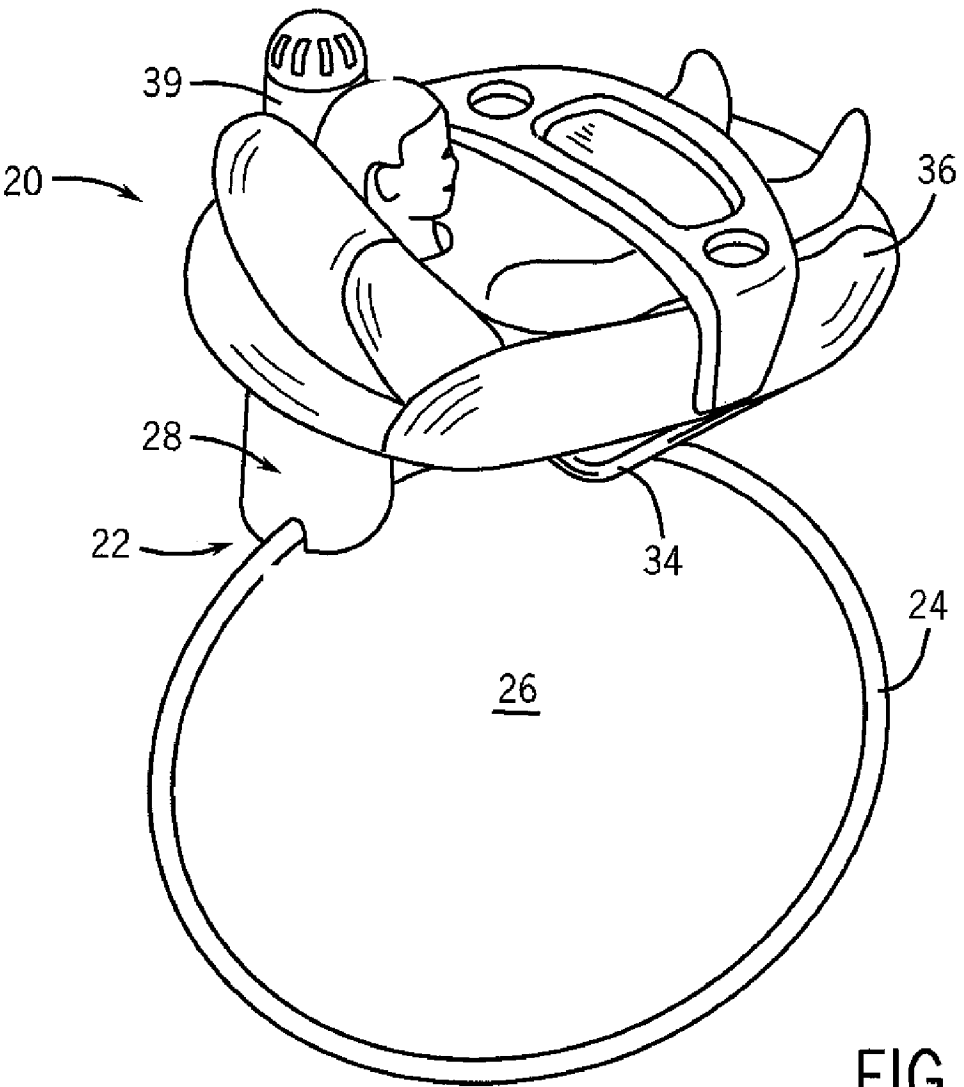
Figure 5:
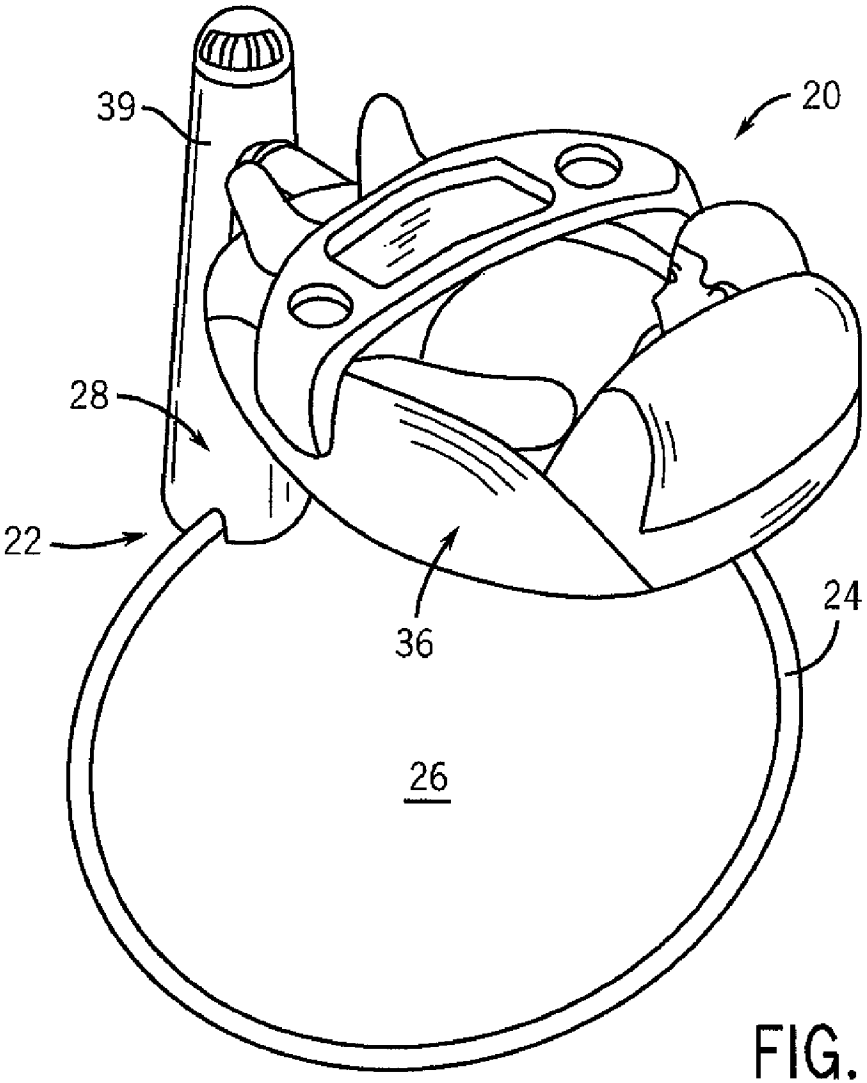

FIGS. 2-5 illustrate one example of an array of optional child seat orientations permissible by the square shape of the seat holder 34 in this example. As shown in FIG. 2, the child seat 36 can be positioned on the seat holder 34 of the support arm 30 with the axis of rotation R positioned on the right had side of the child. FIG. 3 shows another optional seating orientation where the position of the axis of rotation R is located behind the child seat. FIG. 4 shows another optional seating orientation where the position of the rotation axis R is on the left hand side of the child seat. FIG. 5 shows a further alternative seating orientation wherein the child seat faces the position of the rotation axis R of the support arm. By placing the seat 36 in different orientations in the holder, the child can experience different relative motions and a variety of different visual environments without changing the support arm travel characteristics.

The exemplary child motion device depicted generally in FIGS. 1-5 is constructed according to one aspect of the disclosure to simulate or mimic various movements that might be employed by a mother or father as they hold a child in their arms. An adult holding a child will often alternate raising and lowering their shoulders or pivoting their torso from side-to-side to simulate a rocking movement. Other times, an adult may hold the child in their arms and twist their torso from side-to-side creating a sway motion for the child through a segment of an arc. Other times, the adult may simply sway the child back and forth by laterally moving their elbows from side to side while holding the child. Sometimes an adult may employ a combination of such movements and/or may lean forward and tilt their spine at an angle toward the child when doing these motions.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate the characteristics of any or all of these various proven, natural, calming and soothing movements. One characteristic involves the frequency of the oscillation. A parent usually holds a child and moves them in a slow, even rhythm to help calm or soothe the child. As described further below, the disclosed devices can be constructed to operate in a manner that also mimics the degree and frequency of motion that a child might experience when held in an adult's arms.

Figure 6A:
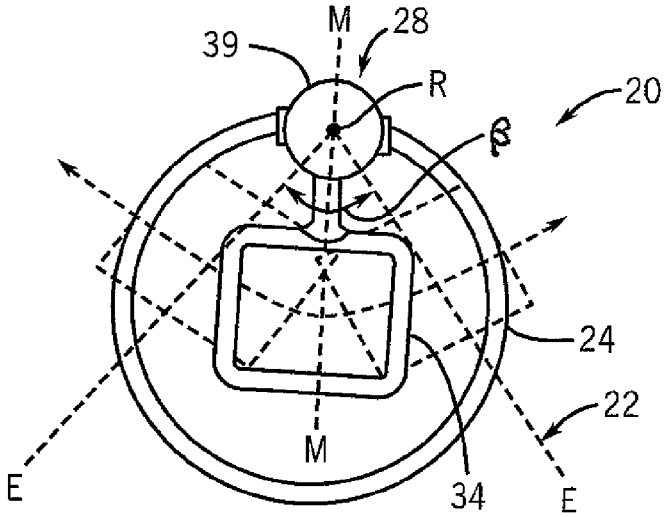
FIG. 6A is a schematic top view of an exemplary child motion device configured to provide an orbital or circumferential arc-shaped motion path for a swing arm in accordance with one aspect of the disclosure.

The various motions for the disclosed devices herein can be achieved in a wide variety of ways. FIGS. 6A-8B illustrate a few examples of alternative child motion device constructions and arrangements. FIG. 6A shows a top view of the child device 20. As shown, the support arm 30 can rotate and reciprocate through an arc of travel less than a full circle. In one example, the support arm 30 can rotate between two extremes E through an angle β of 120 degrees. This angle can vary, can be greater than 360 degrees, can be less than 120 degrees, and yet can fall within the spirit and scope of the disclosure. The support arm 30 is described herein as being substantially horizontal and the rotation axis R as being substantially vertical herein, even though they may be angularly offset from these references, as is illustrated in a number of the drawing figures herein.

Figure 6B:
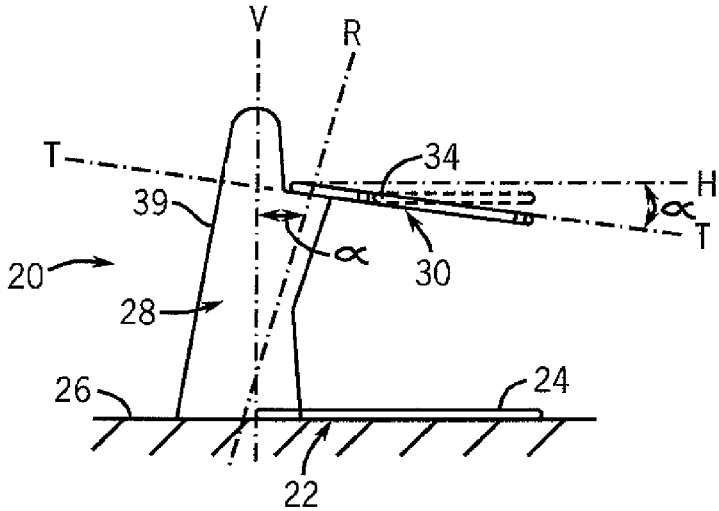
FIGS. 6B and 6C are schematic side views of further examples of child motion devices configured to provide alternative swing arm motion paths in accordance with the teachings of the disclosure.
Figure 6C:
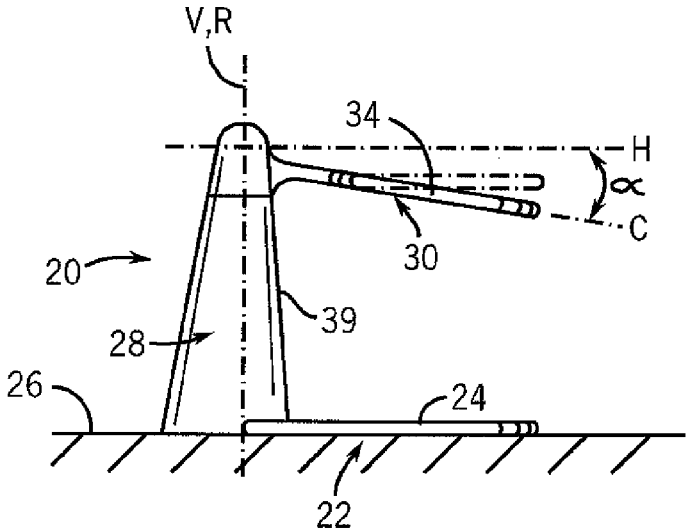

FIGS. 6B and 6C show alternative arrangements for the device 20 to produce slightly different motion paths. As shown in FIGS. 6B and 6C, the support arm 30 can rotate about an axis of rotation R. The axis of rotation R can be aligned with a vertical axis V relative to the reference plane, as shown in FIG. 6C. However, in the example shown in FIG. 6B, the support arm 30 tilts at an angle α relative to the horizontal reference H and is perpendicular to its axis of rotation R. As a result, the axis of rotation R also tilts at the angle α relative to the vertical reference V. In other examples, including some of those described below, the two angles may differ to produce further varying motion paths. In one example, the angle α may be about 15 degrees, but the angle may be less than 15 degrees, 0 degrees, or greater than 15 degrees, and yet fall within the spirit and scope of the disclosure. The support arm and/or the axis of rotation may even be tilted away from the travel arc if desired.

In a vertically offset arrangement (e.g., FIG. 6B), the support arm will sweep through its arc or travel in a plane that is tilted to horizontal. The actual motion of the seat holder 34 will thus have a rotational motion path about its axis R that includes a horizontal component as well as a vertical component. The holder 34 will vary in positional height (or altitude) between a low elevation point and a high elevation point as it moves along the path within the tilted travel plane T. These elevations can be set to occur anywhere along the travel arc, depending upon where the mid-point M of the travel arc of the seat holder is designed to occur. If the mid-point M of the travel arc is set at the lowest elevation of the travel plane T defined by the seat holder travel arc, equal high points will occur at the opposite extremes E of the arc. This configuration may best simulate the motion that a child might experience when held in their parent's arms.

In FIG. 6C, another alternative motion path is shown. In this example, the axis of rotation R is precisely vertical and co-linear with the vertical reference axis V (as well as the spine axis in this example). However, in this example the support arm is tilted at an angle α downward from a horizontal reference H. The seat holder will thus travel in a horizontal plane through a circular arc. The support arm 30 will thus move through an arc of a segment of a cone C and not in a plane. The child seat holder 34 in this example is tilted slightly away from the spine 28. Alternatively, the seat holder 34 may be oriented parallel to the horizontal reference H or tilted at an angle upward therefrom, as desired. This is also true for the example of FIG. 6B.

In any of these examples, the support arm 30 can be bent or oriented such that, at least at the low elevation point, or the mid-point, of the travel arc, the seat is oriented level with the floor surface or horizontal. FIGS. 6A and 6B show such a seat holder orientation in dashed line. The seat holder angle relative to the support arm can vary and can even be adjustable to provide additional motion path alternatives for the seat occupant.

Figure 7A:
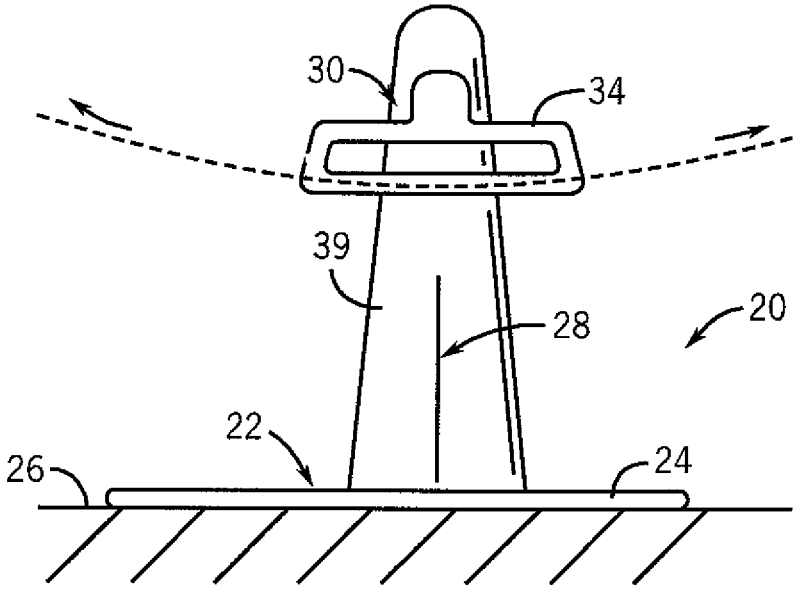
FIGS. 7A and 7B are schematic front views of still further examples of child motion devices configured to provide further alternative swing arm motion paths in accordance with the teachings of the disclosure.
Figure 7B:
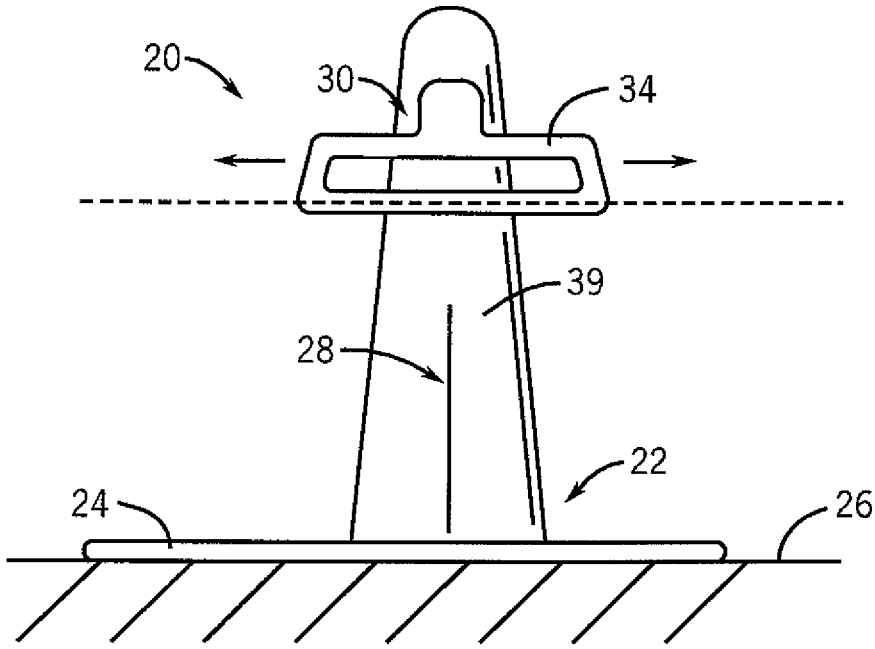

FIGS. 7A and 7B are front views that also depict alternative motion paths that can be incorporated into, or provided by, the device 20. The front view of FIG. 7A is representative in one example of the travel path for the child seat of the device shown in FIG. 6B. The seat holder will travel both side to side and will sweep through an are with both a horizontal component and a vertical component to its motion. This is because the support anal 30 moves in a travel plane T tilted at an angle α relative to the horizontal reference. The front view of FIG. 7B is representative of the travel path for the child seat of the device shown in FIG. 6C. The child seat of this device will move in a horizontal travel plane.

FIG. 7A can represent other motion path alternatives as well. Cam surfaces at the driven end 32 of the support arm 30 can be designed, or other mechanical means can be employed, in the device 20 to impart optional vertical movement of the support arm as it sweeps through its travel arc. The arm can be caused to vertically move in the direction of its rotation axis R (see FIG. 8A as representative of the motion) or vertically pivot (see FIG. 8B as representative) as it reciprocates from side-to-side and according to its position along its travel arc. In one example, a four-bar or other mechanical linkage arrangement can be employed in the drive system or even in the support arm and/or the holder construction. Such linkage arrangements could be employed to create optional motions in different directions including pivoting vertical movement of the arm, linear vertical movement of the arm, longitudinal movement of the arm, longitudinal rotation of the arm, or the like. Further examples of these types of generally vertical movement are described below in connection with FIGS. 18-22.

Figure 8A:
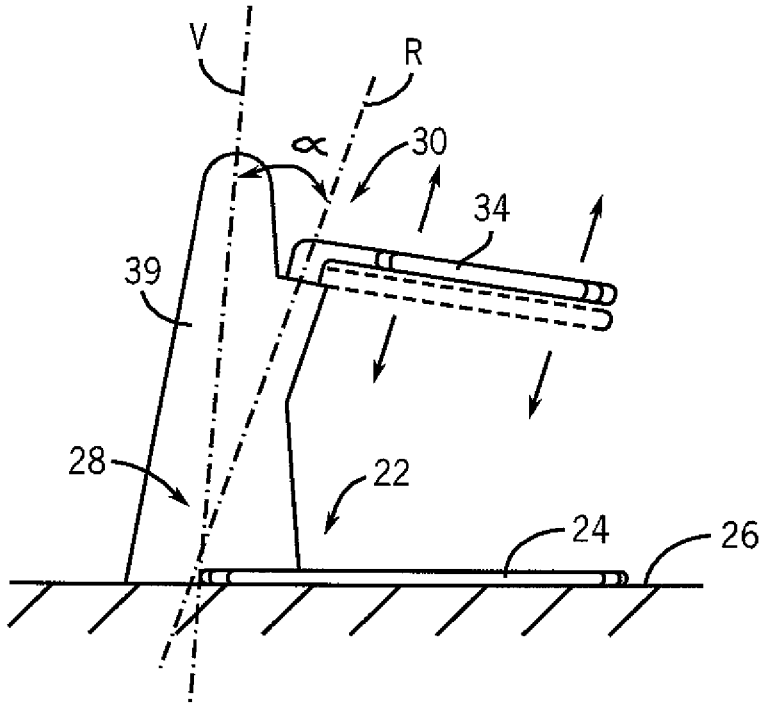
FIGS. 8A and 8B are schematic side views of still further examples of child motion devices configured to provide still further alternative swing arm motion paths in accordance with the teachings of the disclosure.
Figure 8B:
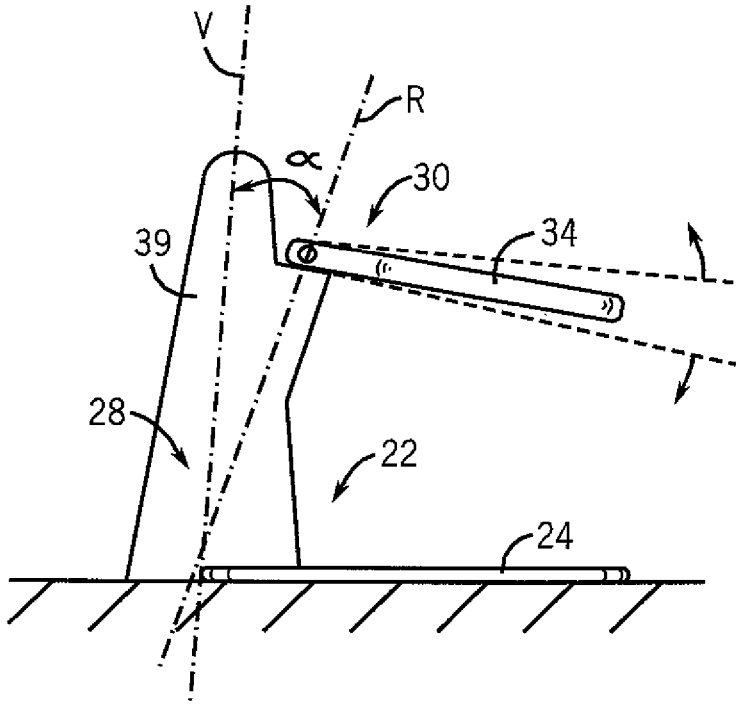

FIGS. 8A and 8B also are representative of vertically reciprocating or bouncing motion. The bouncing or oscillating vertical motion can be imparted using a spring, as is described below as well. The bouncing motion feature can optionally be designed as a separate motion option for the device, such that the child seat can be bounced even while the support arm does not reciprocate rotationally, or as an additional motion that can concurrently occur along with rotational movement of the support arm. The vertical motion can again be angular as shown in FIG. 8B, or can be linear as shown in FIG. 5A.

The type and complexity of the motion characteristics imparted to the support arms disclosed herein can vary and yet fall within the spirit and scope of the disclosure. If desired, the support arm may, for example, also be designed to travel through 360 degrees or more before changing directions. The seat holder 34 and/or the support arm 30 may also be angularly adjustable if desired, to further alter the motion experienced by a seat occupant. FIG. 5B is also representative of one example of this type of adjustment feature that can be optionally added to disclosed devices. Additionally, the support arm may be length adjustable, if desired, to create even more motion versatility in the device 20. This type of adjustment may provide a user with an option to modify the natural resonant frequency of the system, as described below, which, in turn, changes the operational (e.g., oscillation) frequency of the device. Alternatively or additionally, the seat position may be slidably adjustable or location-specific adjustable along the support arm from the distal end inward toward the driven end. Such seat location-based adjustments can also be used to effectuate the above-described frequency adjustments.

Figure 9:
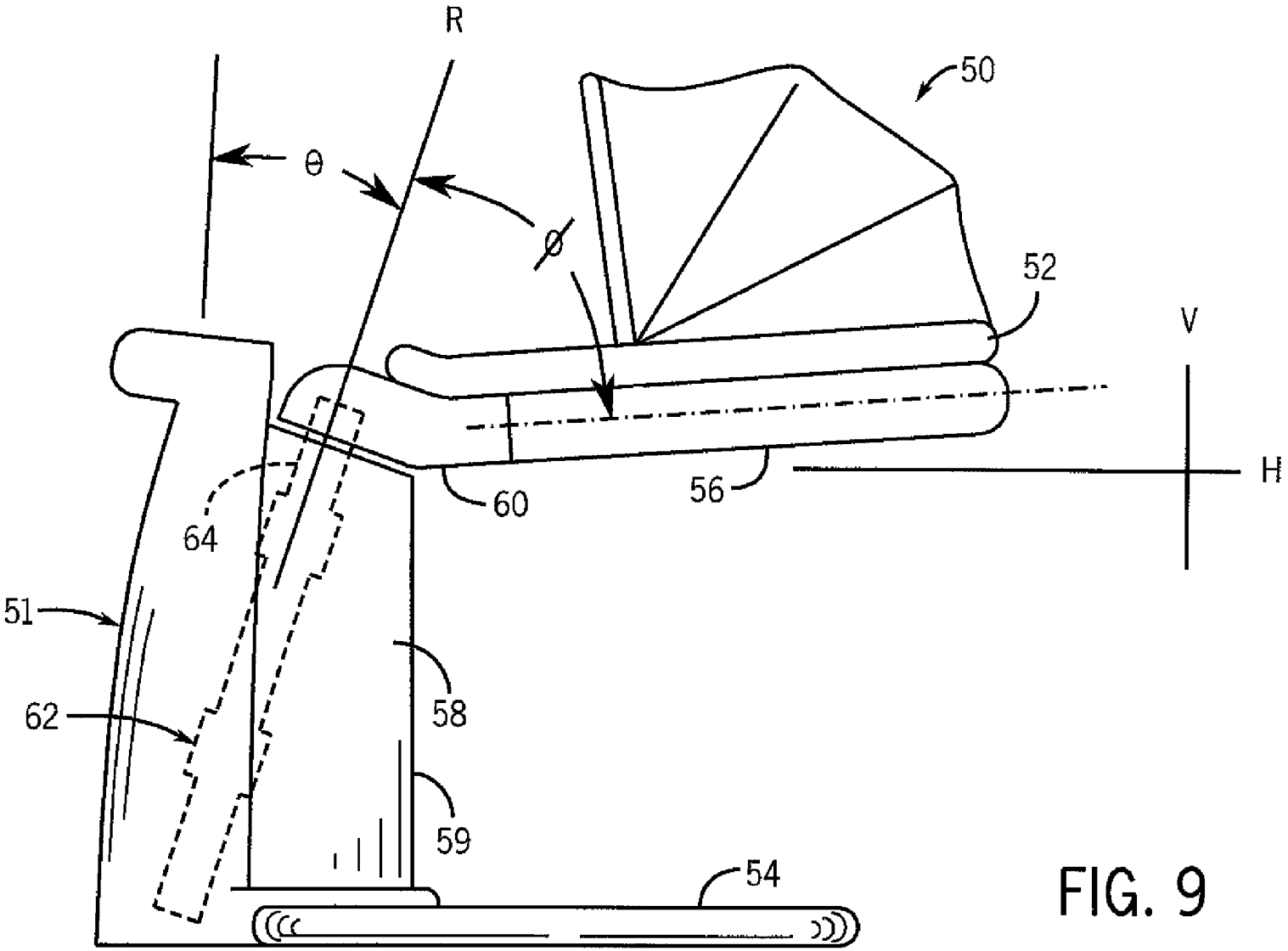
FIG. 9 is an elevational side view of another exemplary child motion device configured to provide a swing arm motion path having both azimuthal and altitudinal changes in accordance with one aspect of the disclosure.
Figure 10:
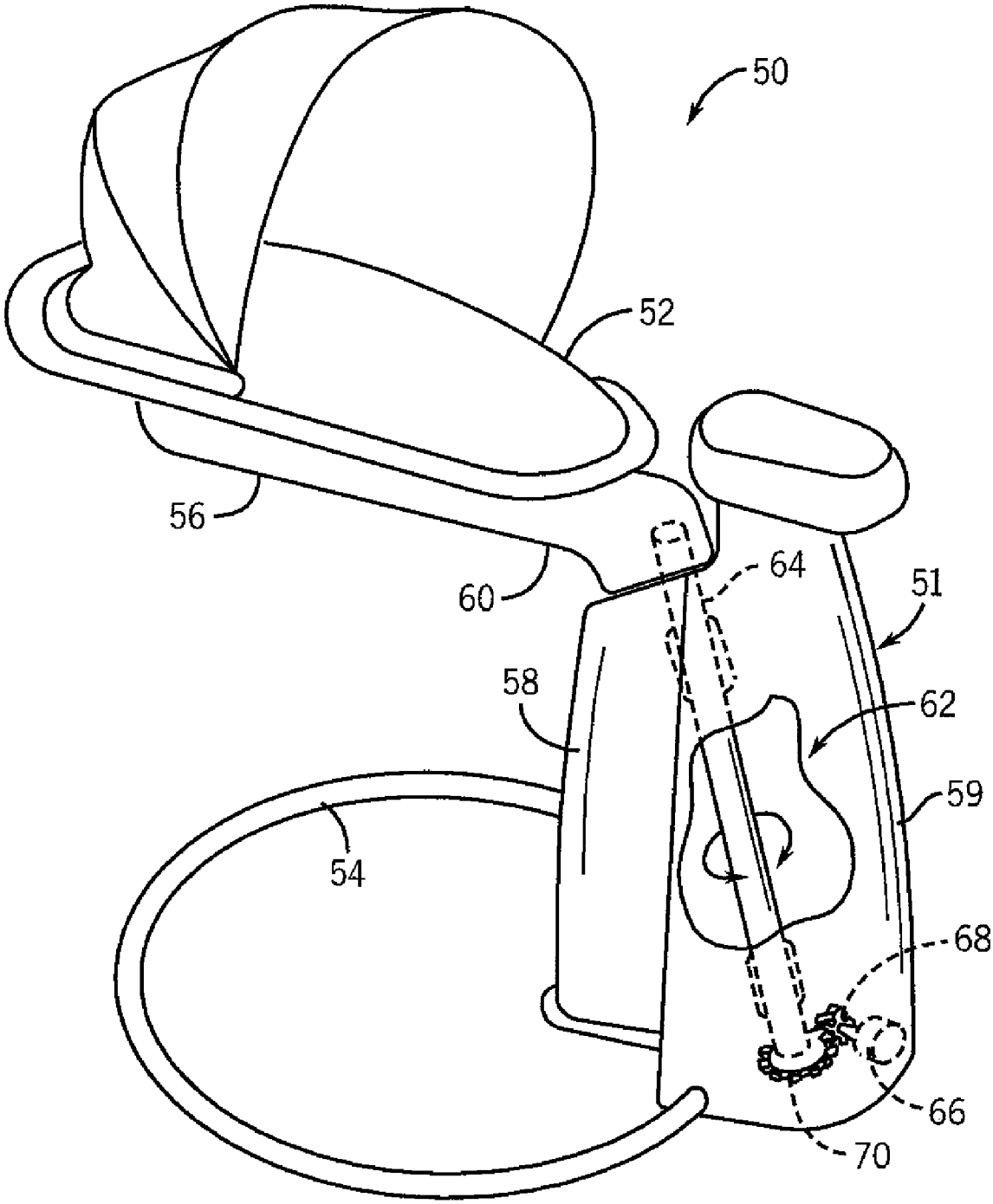
FIG. 10 is perspective, cutaway view of the child motion device of FIG. 9 showing a rotational axis of a drive system offset from vertical in accordance with one aspect of the disclosure.

FIGS. 9 and 10 depict an exemplary child motion device indicated generally at 50 configured for oscillation at a desired frequency in accordance with one aspect of the disclosure. The configuration of the device 50 orients the child occupant such that the characteristics of the movement, and the frequency in particular, mimic the soothing motion provided to a child by a caregiver. The device 50 is described below to provide further details regarding one example of a child motion device having a complex motion path (e.g., other than a simple pendulum) and how, in some cases, the complex motion path can support movement within the desired frequency range. The following description is provided with the understanding that many, if not all, of the details are equally or similarly applicable to one or more of the devices and device configurations described above.

The child motion device 50 may generally be constructed in a manner similar to the devices described above. For example, the device 50 in this example generally includes a frame assembly 51 configured to support an occupant seat 52 above the surface upon which the device 50 is disposed. A base section 54 of the frame assembly 51 rests upon the surface to provide a stable base for the device 50 while in-use. The frame assembly 51 also includes a seat support frame 56 on which the seat 52 is mounted. The seat 52 and the seat support frame 56 may be configured as described above to support a number of optional seat orientations. The seat frame 56 is generally suspended over the base section 54 to allow reciprocating movement of the seat 52 during operation. To that end, an upright post 58 of the frame assembly 51 extends upward from the base section 54 to act as a riser or spine from which a support arm 60 extends radially outward to meet the seat frame 56.

In this example, the post or spine 58 is oriented in a generally vertical orientation relative to its longitudinal length. The post 58 has an external housing 59 that may be configured in any desired or suitable manner to provide a pleasing or desired aesthetic appearance.

Within the housing 59, the device 50 includes a drive system indicated generally at 62 and schematically shown in FIG. 10. The drive system 62 generally defines an axis of rotation R (FIG. 9) from which the support arm 60 is cantilevered, and about which the support arm 60 reciprocates as described above. To that end, the drive system 62 includes a drive shaft 64. In this example, the shaft 62 is a tube-shaped rod connected within the frame assembly 51 to transfer motion from the drive system 62 to the support arm 60. The shaft 62 and, therefore, the axis of rotation R, extend upward at an angle θ relative to the vertical reference. In operation, an electric motor 66 (e.g., a DC electric motor) drives a gear train having, for instance, a worm gear 68 and a worm gear follower 70, which are depicted schematically for ease in illustration.

In some cases, the worm gear follower 70 may carry a pin or bolt (not shown) which acts as a crank shaft. In this case, the motor 66 always turns in the same direction, and the pin is displaced (i.e., offset) from the rotational axis of the gear follower 70, such that rotation of the gear follower 70 causes the pin to proceed in a circular or rotary path. The free end of the pin extends into a vertically oriented slot of a U-shaped or notched bracket (not shown) coupled to the shaft 62. In this way, the movement of the pin along the circular path is transformed from pure rotary motion into the oscillating or reciprocating motion of the shaft 62. Despite the single direction of the motor 66, the notched bracket is displaced in one direction during one half of the cycle, and the opposite direction during the other half of the cycle. The energy of the crank shaft transferred to the notched bracket then acts on a swing pivot shaft (not shown) via a spring (not shown). The swing pivot shaft is then linked or coupled to the drive shaft 62 to oscillate the support arm 60 through its motion pattern. The spring, in this example, can act as a rotary dampening mechanism as well as an energy reservoir. The spring can be implemented to function as a clutch-like element to protect the motor by allowing out-of-sync motion between the motor 66 and the shaft 62. Thus, the shaft 62 in this case is not directly connected to the motor 66, thereby forming an indirect drive mechanism.

The disclosed child motion devices may, but need not, utilize an indirect drive technique to allow the motor to support motion at the natural resonant frequency of the device. As described above, an indirect drive is generally applied to overcome the damping present in the system, while otherwise allowing the system to move at resonance. Examples of suitable motor drive systems and related techniques are described in U.S. Pat. No. 5,525,113 ("Open Top Swing and Control"), U.S. Pat. No. 6,339,304 ("Swing Control for Altering Power to Drive Motor After Each Swing Cycle"), and U.S. Pat. No. 6,875,117 ("Swing Drive Mechanism"), the disclosures of which are hereby incorporated by reference in their entirety.

Practice of the disclosed devices and methods is not limited to the above-described indirect drive technique, but rather may alternatively involve any one of a number of different motor drive schemes and techniques. As a result, the components of the drive system can vary considerably and yet fall within the spirit and scope of the present invention. The exemplary drive system 62 provides reciprocating motion well-suited for use in connection with the child motion device 50, inasmuch as the drive mechanism and the mechanical linkage thereof allow for some amount of slippage in the coupling of the motor to the occupant seat. Nonetheless, there are certainly many other possible drive mechanisms or systems that can alternatively be employed to impart the desired oscillatory or reciprocating motion to the support arm 60 of the devices disclosed herein.

One such technique involves a direct drive mechanism in which the motor shaft is mechanically linked to the swing pivot shaft without allowing for any slippage. In this case, the motor may be driven in different directions via switched motor voltage polarity (i.e., forward and reverse drive signals) to achieve the reciprocating motion. The mechanical linkage is then configured to accommodate the bi-directional motion, unlike the worm gear and other mechanical linkage components in the exemplary drive system described above. The motor can be powered in either an open-loop or closed-loop manner. In an open-loop system, electrical power is applied to the motor with the alternating polarities such that swing speed (or swing angle amplitude) may be controlled through adjusting either applied voltage, current, frequency, or duty cycle. An alternative system applies power at a fixed polarity with the reciprocating motion developed via mechanical linkage. Closed-loop control of a direct drive system may involve similar control techniques to those implemented in open-loop control, albeit optimized via position feedback techniques. With the feedback information, the applied voltage and other parameters may be adjusted and optimized to most efficiently obtain or control to desired swing amplitudes.

Other optional drive techniques may include or involve spring-operated wind-up mechanisms, magnetic systems, electro-magnetic systems, or other devices to convert drive mechanism energy and motion to the reciprocating or oscillating motion of the disclosed devices.

In accordance with one aspect of the disclosure, the device 50 is generally configured to support movement at a frequency that mimics the swaying motion provided by parents. To this end, the drive system 62, whether indirect or direct, moves the support arm 60 such that the seat 52 reciprocates along a motion path at a frequency within a range of frequencies found to be statistically prevalent among caregivers providing a cradling, swaying motion to soothe a child. As described above, the devices described herein are generally configured to mimic a side-to-side, swaying movement that may involve altitudinal changes as well. For this type of soothing movement, parents routinely soothe their children with a low speed sway/swinging motion that is well represented or approximated by a normal distribution (i.e., a Bell curve) with a mean frequency around 0.5 Hz (0.4973 Hz) and a standard deviation of 0.1244 Hz. In one data set, the mean frequency was 0.48 Hz. This empirical data therefore identifies one desired frequency window or range from about 0.37 Hz to about 0.62 Hz. A second desired frequency range supported by the empirical data runs from about 0.4 Hz to about 0.5 Hz. While the exact frequency may depend on the orientation of the seat 52, one exemplary frequency shown to be effective is about 0.4 Hz.

Unlike direct drive systems, where the drive system can be configured to move the support arm at the desired frequency, devices having indirect drive systems are designed to reciprocate at the desired frequency through natural resonance. To this end, one aspect of the disclosure is generally directed to a complex sway motion path that makes it possible to achieve a desired motion frequency through the natural resonance of a system with reasonable device dimensions. Unfortunately, a simple pendulum configuration would require a pendulum arm of 129 feet to obtain a natural resonant frequency around 0.5 Hz. Thus, movement within the low frequency range may be provided via modified pendular movement arising from the configuration and orientation of the support arm and the axis of rotation, as described below.

The frequency of the device 50 is nearly half the frequency of similarly sized conventional pendulum swings as the result of its modified pendulum geometry. More specifically, the geometry generally supports a swing arm motion path having both azimuthal and altitudinal changes. The altitudinal changes are the result of the rotational axis of the drive system being offset from vertical, such that the seat rises against gravity as it approaches each endpoint of a reciprocating stroke. Another feature of the geometry that contributes to both the azimuthal changes and attitudinal changes is the angle of the support arm from the axis of rotation, which results in the support arm tracing a cone, as described above. In the example of FIGS. 9 and 10, the angle is acute such that the cone-shaped path results in a steeper (i.e., quicker) change in altitude toward the endpoints (relative to an orientation with a 90-degree angle).

For the foregoing reasons, the natural frequency of the device 50 remains a function of gravity and the pendulum arm length, but also is dependent upon the angle θ that the axis of swing rotation makes with vertical, and the angle ϕ of the pendulum arm from the rotation axis. The resonant frequency is defined as follows:

$$\omega_n = \sqrt{\frac{g\sin\theta}{L\sin\phi}}$$

The device 50 shown in FIGS. 9 and 10 is one example of a configuration that can be easily dimensioned and otherwise designed to meet the specific frequency metric by changing these device parameters to reach a desired natural resonant frequency for the system. In the example shown in FIG. 9, the natural resonant frequency of the system is changed from an initial frequency based on a pendulum arm length L of 14 inches, a rotation shaft angle θ of 13 degrees, and a pendulum arm angle ϕ from the rotation axis of 73 degrees. The resulting device design frequency $\omega_n$* is a function of the new design parameters L*, θ* and ϕ* that are the sum of the original parameter and the change in the parameter.

$$\omega_n^* = \sqrt{\frac{g\sin\theta^*}{L^*\sin\phi^*}},\ L^* = L + \Delta L,\ \theta^* = \theta + \Delta\theta,\ \phi^* = \phi + \Delta\phi$$

The ratio of the present naturally frequency over the design frequency is a non-dimensional design tool in accordance with the following equation:

$$\frac{\omega_n}{\omega_n^*} = \sqrt{\left(1 + \frac{\Delta L}{L}\right)\left(\frac{\sin\theta}{\sin(\theta + \Delta\theta)}\right)\left(\frac{\sin(\phi + \Delta\phi)}{\sin\phi}\right)}$$

Figure 11:
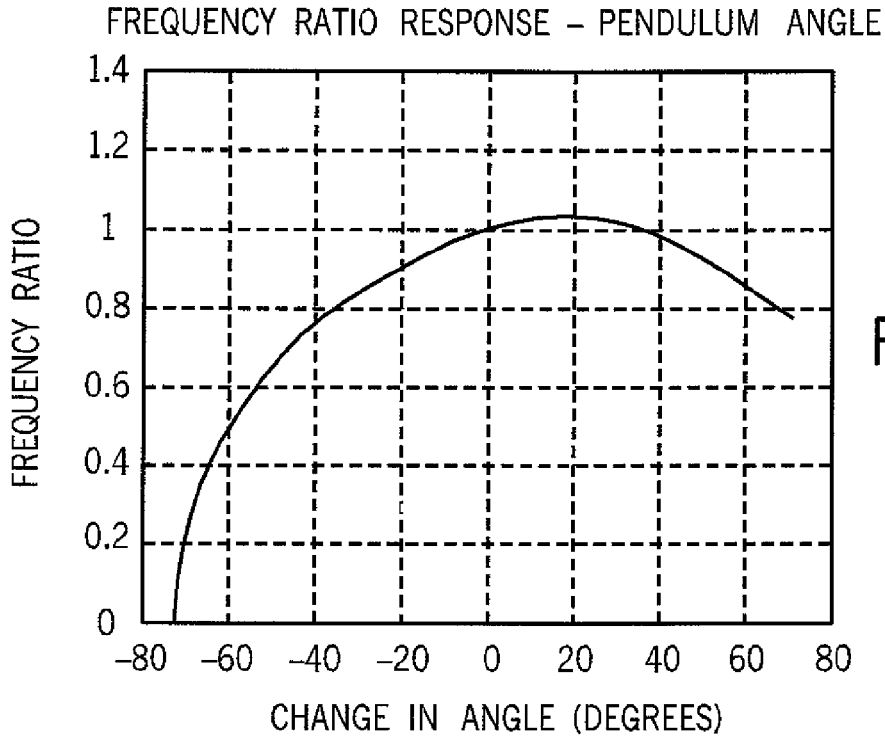
FIGS. 11-13 are graphical plots of natural resonant frequency response ratios for several configuration parameters of the child motion devices constructed in accordance with the teachings of the disclosure.
Figure 12:
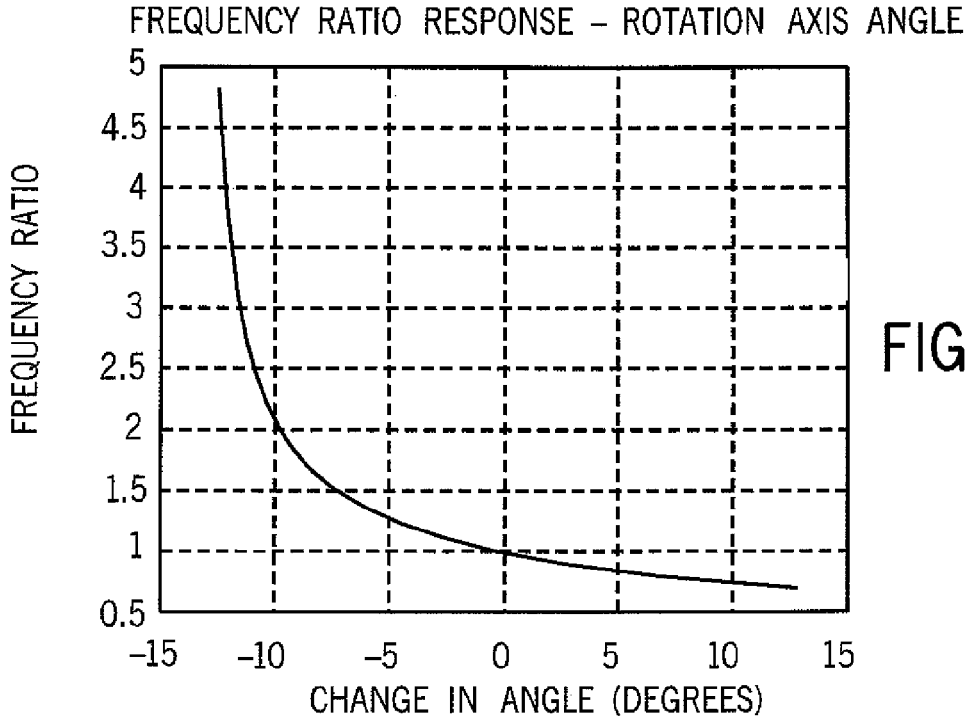
Figure 13:
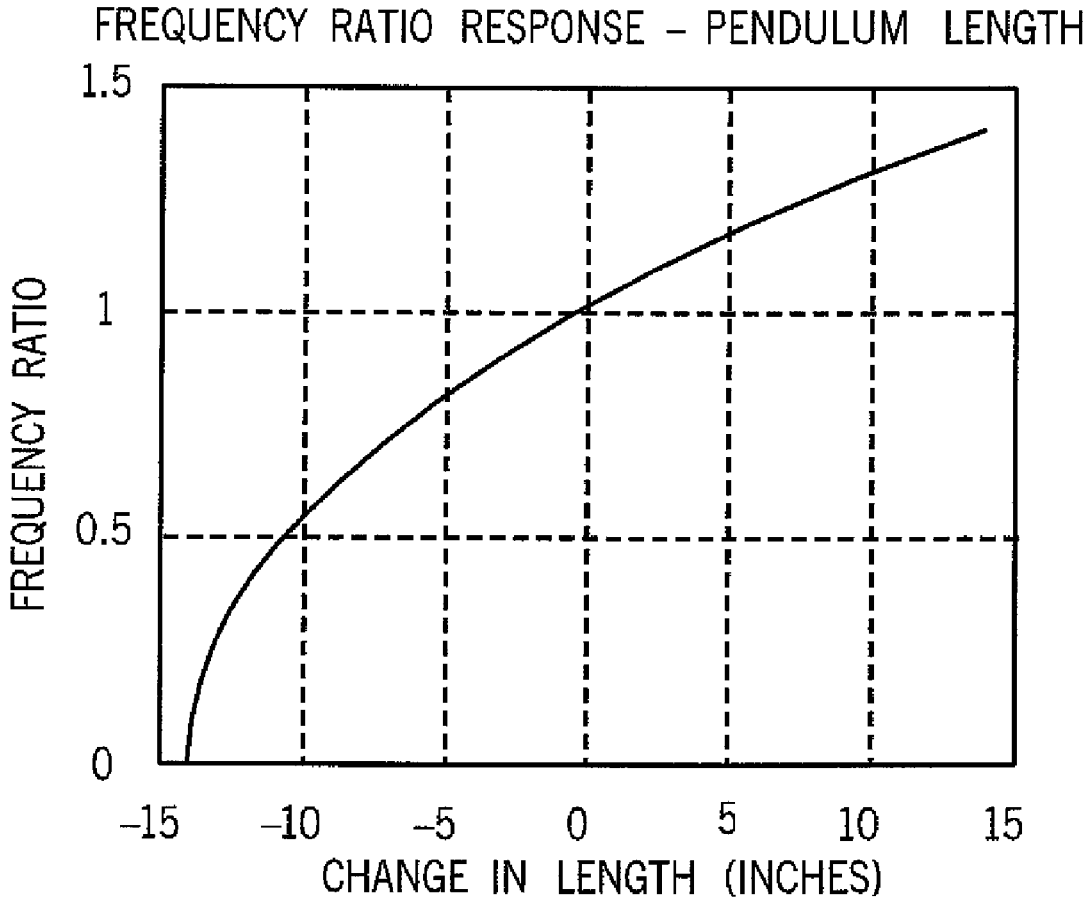

FIGS. 11-13 show the responses of the frequency ratio to changes in these system parameters, i.e., ΔL, Δθ and Δϕ. Exemplary suitable ranges for each of the parameters may thereby be derived from the initial resonant frequency. For example, using the plot in FIG. 16, a range of suitable rotational axis offset angles runs from about 12 degrees to 22 degrees given the aforementioned statistically effective range of frequencies. Further suitable ranges may be derived for the other parameters given an initial resonant frequency (e.g., 0.4 Hz) and the corresponding frequency response plots.

One advantage to the resonant frequency-based motion technique described above is that gravity provides for smooth transitions between the reciprocating strokes. Smooth movement, in turn, leads to a cleaner motion profile. That is, the frequency distribution of the movement provided by the device is not cluttered with undesired frequency components generated from having to forcibly reverse the direction of the support arm. With gravity-based techniques, no physical stop is required to create the reciprocating motion. Without the impact loading that results from a stop, the complex motion paths of the disclosed devices avoid abrupt or jerky movement, leaving only smooth and fluid motion at a predominant, desired frequency.

Another advantage of the resonant frequency-based motion technique is that the child motion devices can be designed to support user-based adjustment or selection of the operational frequency. As described in the above-referenced disclosures, it should be noted at the outset that an indirect drive mechanism can provide varying acceleration levels and, thus, varying speeds. To these ends, the above-described devices may be controllable via a speed selection or setting. However, the result of a change in speed is merely a change in the length of the arc-shaped motion path, leaving the frequency unchanged. To adjust the frequency, any of the above-described motion devices may include, for example, an adjustable support arm or adjustable seat frame. More specifically, adjustments to either the length or orientation of the support arm will result in a modification of the frequency. Similarly, an adjustment to the seat can similarly change the length of the pendulum arm to, in turn, adjust the frequency. In direct-drive embodiments, the frequency can be adjusted by changing the speed and/or cycle of the motor drive. In either case, the child motion devices may be configured to allow and support either structural re-configurations or user-interface selection elements to enable adjustments to the frequency.

Figure 14:
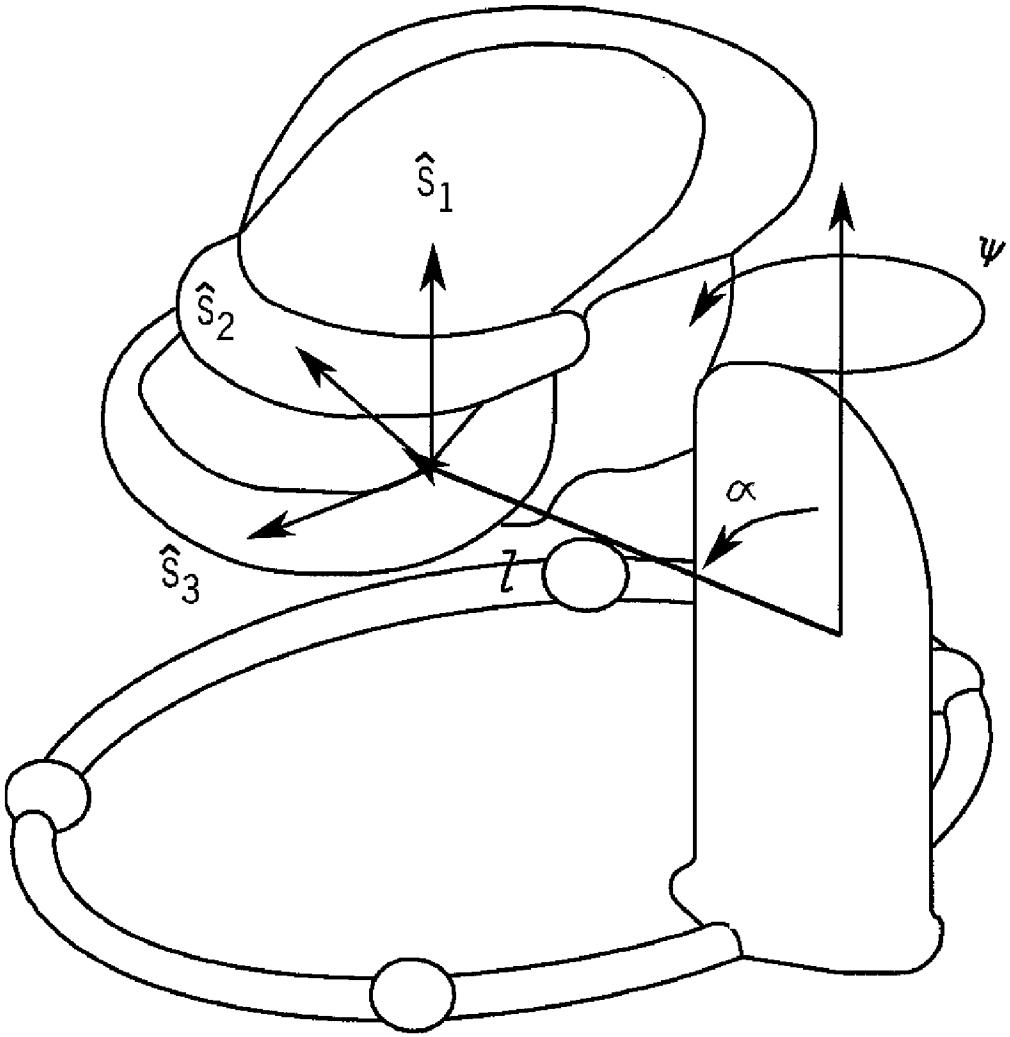
FIG. 14 is a perspective view of yet another exemplary child motion device shown with a reference frame having three coordinate axes for definition of a complex pendular motion path in accordance with one aspect of the disclosure.
Figure 15:
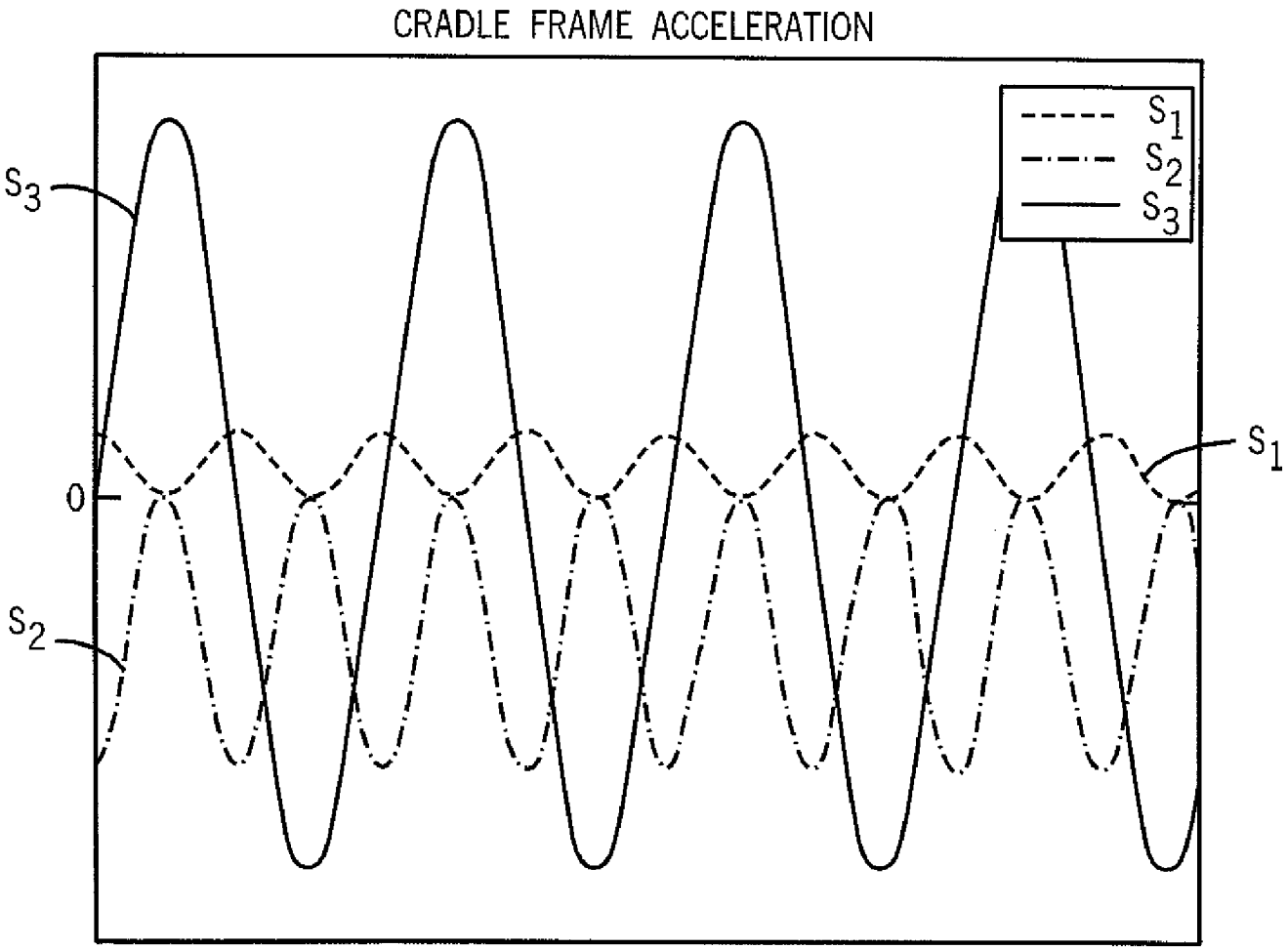
FIGS. 15-17 are graphical plots of exemplary acceleration data for the complex pendular motion path with respect to the reference frame coordinate axes defined in FIG. 11.

Further details regarding the complex pendular motion paths described herein are provided in connection with FIGS. 14-17. Specifically, FIG. 14 is a schematic representation of an exemplary motion device configured similarly to those described above for oscillation at a desired natural resonant frequency, and shown with a coordinate reference frame having three frame axes or vectors. At a general level, the curves shown in each of the acceleration plots in FIGS. 15-17 exemplify the smooth nature of the motion generated via the disclosed complex pendular motion path. More specific details regarding the complex motion paths can be set forth by defining, relative to the reference frame, the rotation axis and pendulum arm extending from the rotation axis to the reference frame. A solution for the complex arc motion path supports the conclusion that the pendulum Length does not drive the overall device size. The device has an acceleration profile not only defined by the length l of the pendulum arm, but also the angle ψ about the rotation axis, and the angle α the pendulum arm makes with the rotation axis. The following swing acceleration equation may be derived via principles of dynamics:

$$\vec{a}_s = \begin{bmatrix} a_{s1}\hat{s}_1 \\ a_{s2}\hat{s}_2 \\ a_{s3}\hat{s}_3 \end{bmatrix} = \begin{bmatrix} l\dot{\psi}^2\sin(\alpha)\cos(\alpha)\hat{s}_1 \\ -l\dot{\psi}^2\sin^2(\alpha)\hat{s}_2 \\ l\ddot{\psi}\sin(\alpha)\hat{s}_3 \end{bmatrix}$$

Figure 16:
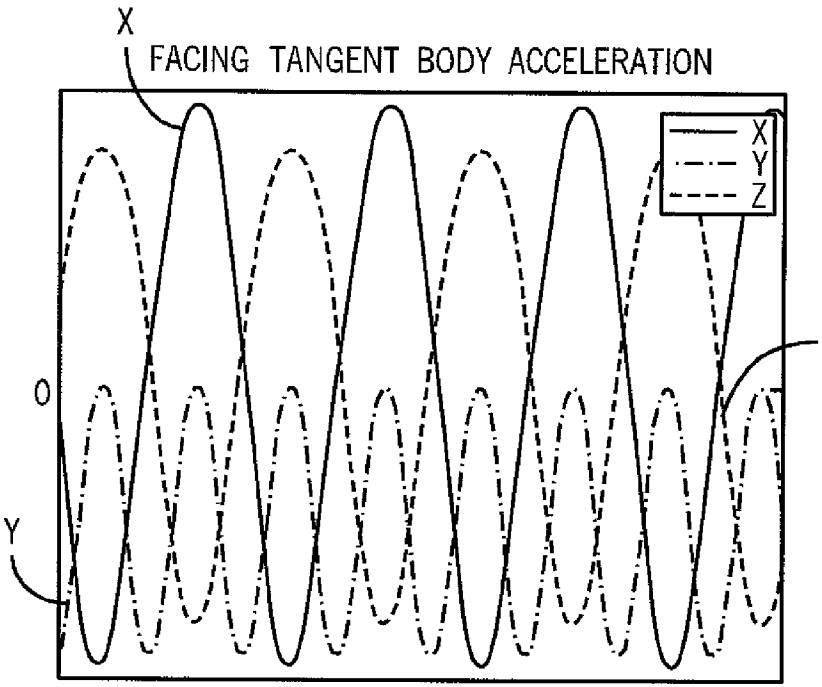
Figure 17:
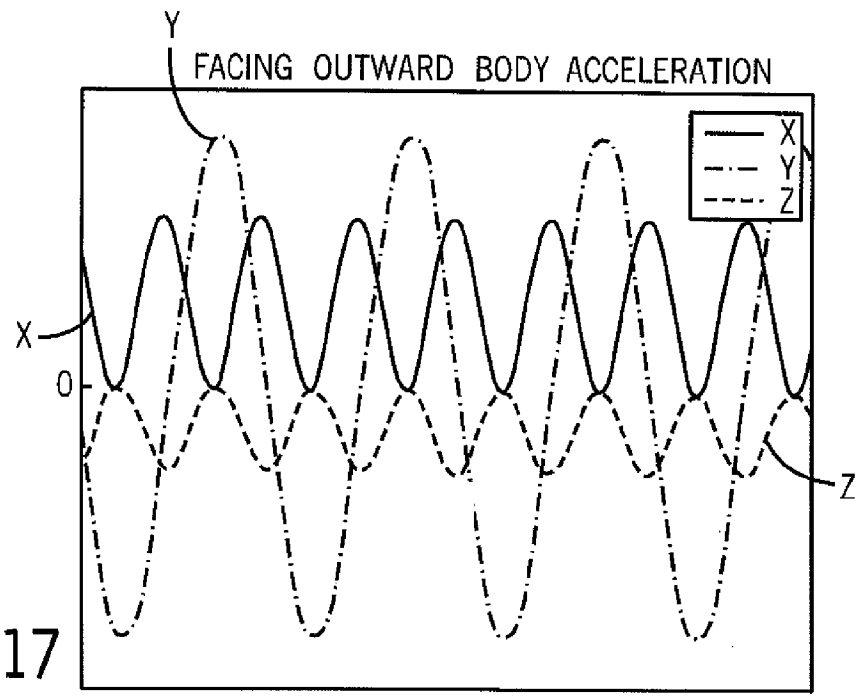

As described above, the cradle of the device can be rotated an angle β about the $\hat{s}_1$ frame vector −90, 0, or 90 degrees for the respective outward, tangent, and inward orientations. The seat, or cradle, also reclines the baby an angle ϕ about the rotated $\hat{s}_2$ vector. FIGS. 16 and 17 depict the acceleration characteristics for the tangent and outward cradle orientations and a given recline angle.

$$\vec{a}_b = \begin{bmatrix} a_x\hat{x} \\ a_y\hat{y} \\ a_z\hat{z} \end{bmatrix}$$

$$C_\phi = \begin{bmatrix} \cos\phi & 0 & -\sin\phi \\ 0 & 1 & 0 \\ \sin\phi & 0 & \cos\phi \end{bmatrix}, C_\beta = \begin{bmatrix} 1 & 0 & 0 \\ 0 & \cos\beta & \sin\beta \\ 0 & -\sin\beta & \cos\beta \end{bmatrix}$$

$$\vec{a}_b = C_\phi C_\beta \vec{a}_s$$

The above-described soothing motion paths are generally designed to mimic a parent cradling the child while swaying back and forth. Such movement can be described as a combination of yaw and roll for the cradle position. Yaw and roll may be considered to correspond with rotational movement about two of the three axes defined in FIG. 14. In this way, the disclosed child motion devices can mimic a parent soothing technique involving rotation about two axes, the lateral axis running between the parent's shoulders, and the vertical axis defining the parent's line of symmetry. While alternative options may include a combination of rotation about the third axis, or pitch, the alternative devices described below address a more common soothing technique, generally vertical bouncing, which is used either alone or in combination with the yaw-roll combination swaying motion paths described above.

In accordance with another aspect of the disclosure, a child motion device is configured to mimic a parent soothing technique involving generally vertical, bouncing movement. This movement has also been found to be statistically uniform, with a principal frequency around 3.0 Hz and a standard deviation of about 0.15 Hz. A number of devices can be configured to impart this relatively high-frequency motion. Suitable solutions generally include, without limitation, vertical piston-based designs (e.g., a pressurized air system or motor-and-crank arrangement oriented along the axis of rotation described above) and radial oscillator designs (e.g., deflections of the support arm for generally vertical oscillation). Described below are specific examples for providing the motion at a desired frequency within the statistical range. The examples are provided with the understanding that they may be combined to any desired extent with any of the foregoing examples directed to providing the swaying motion. A user may then be given the option of selecting one or both of the motion paths for operation. One or both drive systems corresponding with the selected motion path(s) may then be actuated to produce the selected movement at the desired frequency(ies).

Figure 18:
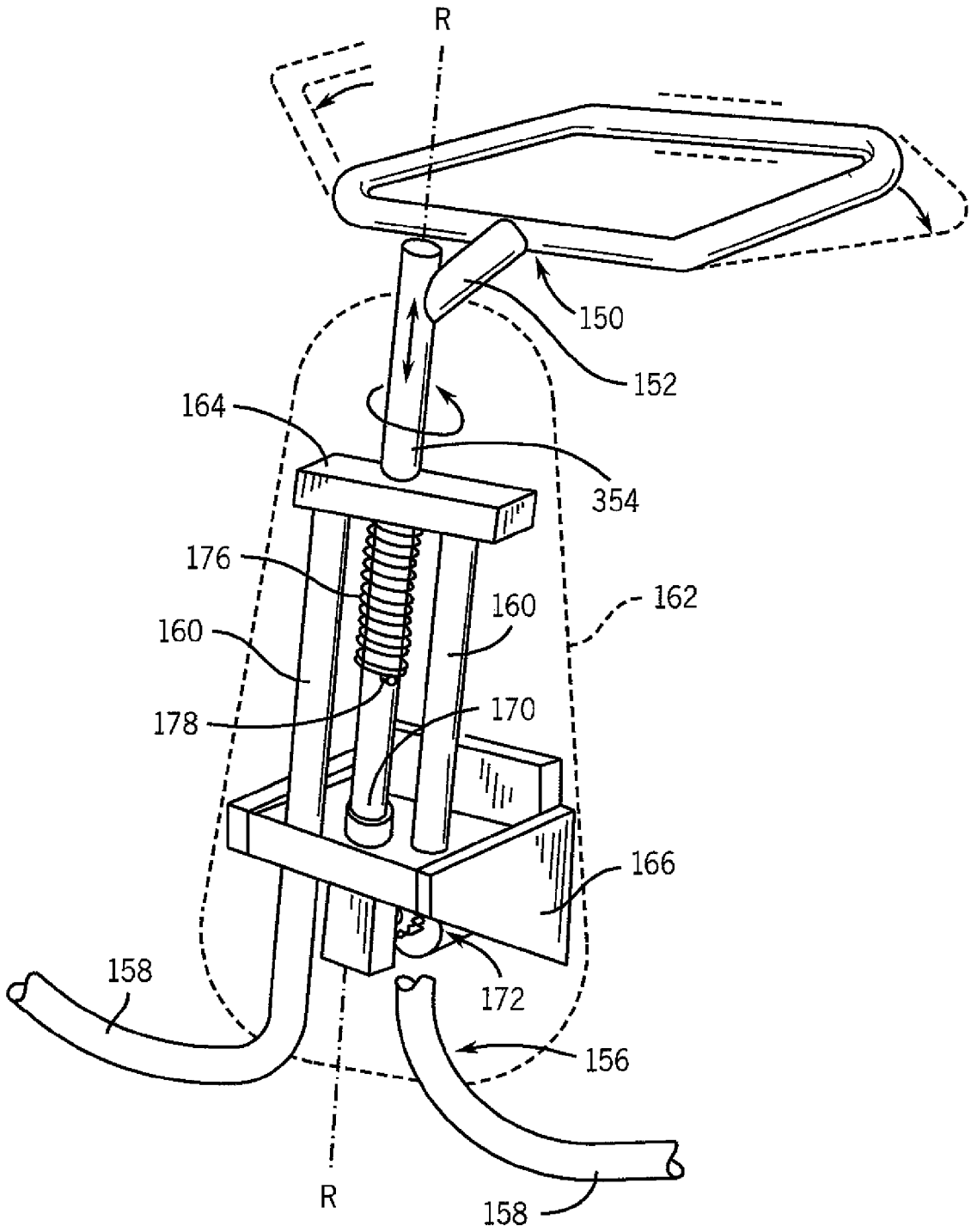
FIG. 18 is a cut-away view of an exemplary support structure and an exemplary drive system of a child motion device constructed in accordance with a powered bouncer aspect of the disclosure.

FIG. 18 shows one of many possible examples in which both swaying and bouncing motion are supported. With regard to the swaying motion, a support arm 150 has a driven end 152 coupled to a pivot rod 154. The rod 154 is supported for rotation in a generally vertical orientation about an axis of rotation R. In this example, the frame assembly has a base section 156 with a pair of legs 158 that each terminate in an upwardly extending part 160 within a housing 162 of the device's spine. These frame parts or legs 158 are linear extensions of the base section 156 and are spaced laterally from one another. Their distal ends 162 are connected to and rotationally retained within an upper bearing block 164. Lower regions of these frame parts or legs 158 are rotationally retained in position within a lower beating block or motor mount 166.

Each bearing block 164, 166 has a central bearing opening for receiving and rotationally supporting the support arm rod 154. In this example, a lower end 170 of the rod 154 can terminate below the lower bearing block 166 and be coupled to a motor or other drive mechanism 172. The drive mechanism 172 may be configured to reciprocally rotate the rod, and thus the support arm, through a predetermined travel angle, such as 120 degrees as described above. The motor or drive mechanism 172 can include features that can be manipulated by a user to adjust the angular travel, the speed of rotation, and the like. An operator panel, touch pad device, a remote control unit, or user interface can be provided on a portion of the housing 162 with buttons, a touch screen, a keypad, switches, combinations of these features, or the like that a user can manipulate to access, operate, adjust, and alter various performance characteristics of the device. FIG. 1 shows one example of a touch pad, screen or other user interface element 174 carried on an upper part of the housing 39.

Though not shown in detail herein, the components of the drive mechanism may vary considerably and yet fall within the spirit and scope of the present disclosure. In one example tested and proven to function properly, the drive mechanism can be in the form of an electromechanical system coupled to the rod to generate the desired motion. In one example, an electric DC or AC motor can be coupled to a worm gear, which can then be coupled to a worm gear follower. The follower can drive a crank shaft. The energy of the drive shaft can be transformed from pure rotary motion to an oscillating or reciprocating motion through a notched bracket, which in turn is coupled to a spring. The spring can be coupled to the rod to oscillate the support arm through its motion.

The spring (not shown) can act as a rotary dampening mechanism as well as an energy reservoir. The spring can be implemented to function as a clutch-like element to protect the motor by allowing out-of-sync motion between the motor and rod. Thus, the rod need not be directly connected to the motor. There are certainly many other possible drive mechanisms or systems that can also be employed to impart the desired oscillatory or reciprocating motion to the support arm of the devices disclosed herein. These can include spring-operated wind-up mechanisms, magnetic systems, electromagnetic systems, or other devices to convert drive mechanism energy and motion to the reciprocating or oscillating motion of the disclosed devices. In each case, the construction of the devices disclosed herein allow the drive system parts to be housed in a housing and positioned below the child seat level. The mechanisms are thus out of the way, resulting in reduced noise levels to an occupant, a highly compact product configuration, and virtually unimpeded access to the child seat.

Figure 20:
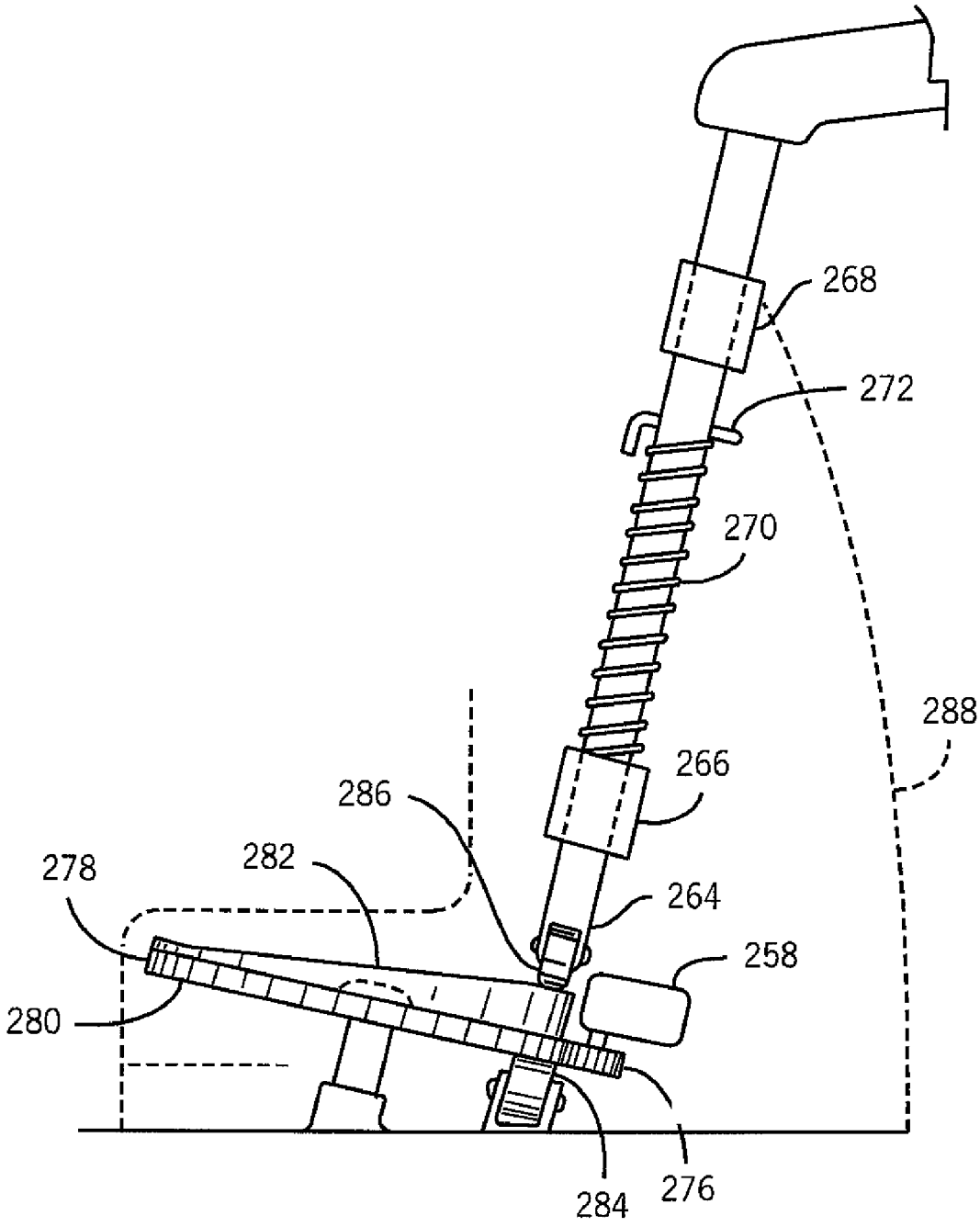

With continued reference to FIG. 20, one example of a structure that can impart the desired bouncing movement involves a spring-based system configured to oscillate at the desired frequency. To that end, a spring 176 is captured between the upper bearing block 168 and spring stops 178 positioned on the rod 154. The drive mechanism may be configured to impart a vertical movement or oscillation to the lower end 170 of the rod 154 along its axis. As described further below, the spring 176 can dampen but assist in retaining oscillatory bouncer movement to the support arm. For example, a spring coupled to the drive system may compress and expand at its natural frequency, which may be matched to the desired frequency. In this way, a drive mechanism (e.g., a solenoid and electromagnet arrangement) is used as an energy restoration mechanism to maintain a constant bounce amplitude and thereby overcome any frictional losses in the system. Alternatively, the rod 154 and spring 176 may be mechanically constructed to permit movement of the seat in the support arm 156 to create occasional, user-initiated bouncing motion. For example, a child's motion or a parent's touch can impart such mechanical bouncing motion.

Figure 19:
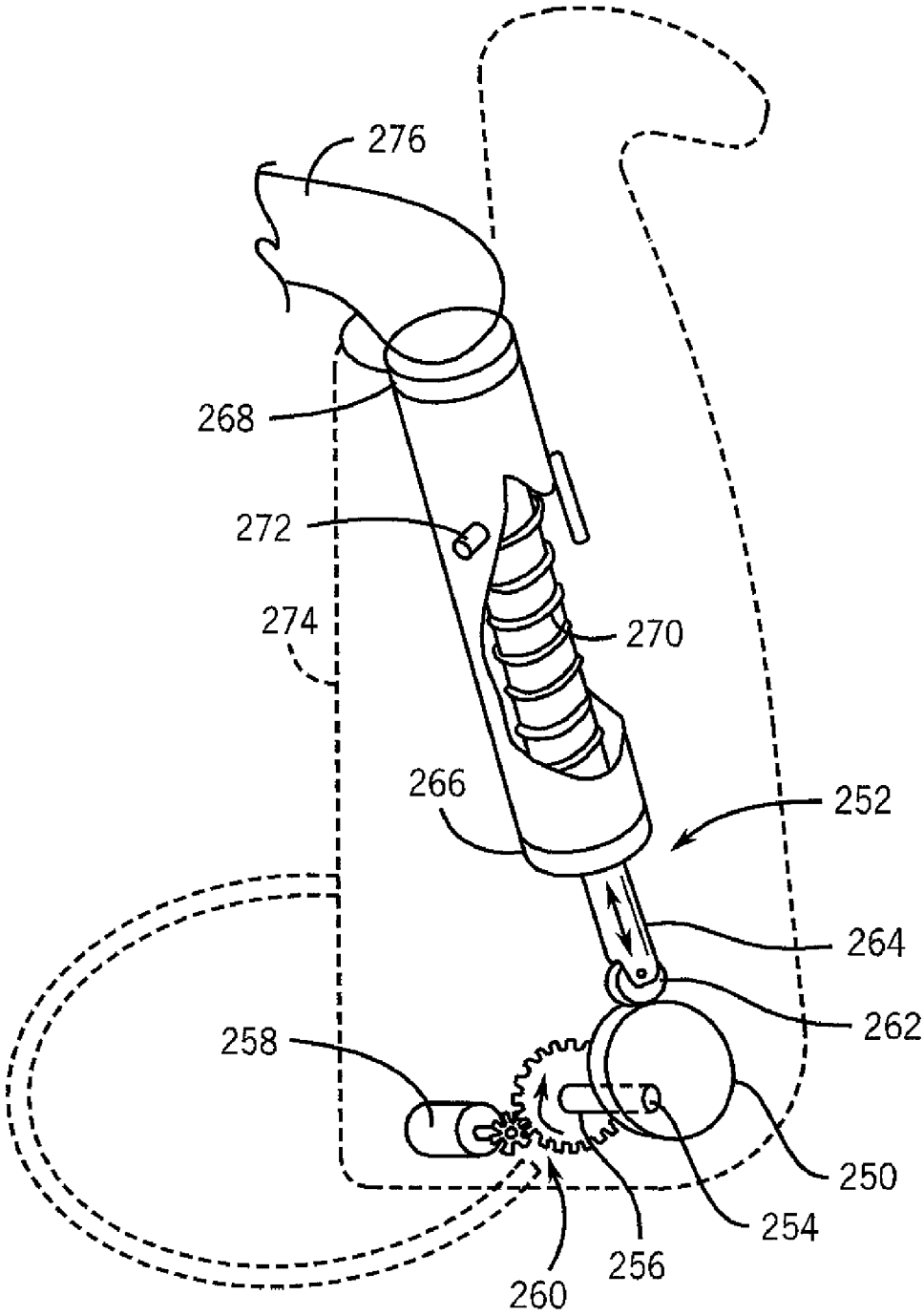
FIGS. 19 and 20 are perspective cutaway views of examples of cam-based drive systems of a child motion device configured to provide bouncing movement in accordance with one aspect of the disclosure.

FIGS. 19 and 20 are directed to alternative configurations for achieving the bouncing motion at a desired frequency within the effective range. Each embodiment generally includes a cam to generate sinusoidal motion along generally vertical shaft or rod, which may correspond with the axis of rotation described above in connection with the swaying motion. While some examples may rely on the cam alone to support the weight of the child, both depicted embodiments reduce the load on the cam with a spring configured to offset the static weight of the child.

With reference to FIG. 19, a bouncer drive system includes a cam 250 configured to generate a sinusoidal motion in a follower arrangement indicated generally at 252. The cam 250 may be configured as a disk- or circle-shaped structure with a hole 254 offset from the center by a distance corresponding with half of the displacement of the desired bouncing motion. The cam 250 is rotated with a shaft 256 conventionally configured with a key and support elements to constrain its rotation. The rotation is driven by a motor 258 coupled to the shaft 256 via gearing indicated generally at 260. The gearing 260 may include a gear pair or train including a worm and a worm follower to address any back torque from the cam 250.

A wheel follower or bearing 262 is held in contact with a follower shaft 264, which, in turn, is held in a generally vertical orientation by axial collars 266, 268. The axial collar 266 provides a base for a compression spring 270 used to remove the static weight of the child from the cam 250, which, in turn, reduces the torque requirements of the drive mechanism. To that end, a spring stop 272 is positioned such that the spring 270 is compressed to an extent that the wheel follower 262 just touches the cam 250 at the low amplitude point. In this example, the spring stop 272 is shaped as a pin fed through the follower shaft 264. To accommodate children of varying weight, a number (e.g., a dozen) of evenly spaced holes may be formed in the follower shaft 264 to accept the pin.

The exemplary drive system shown in FIG. 19 may be integrated with one of the motion devices described above to any desired extent. In this example, the drive mechanism is disposed in a housing 274 similar, if not identical, to the housing 59 of the embodiment shown in FIG. 9. The collars 266, 268 may be fixed to the housing 274 or a support structure disposed therein. The follower shaft 264 may be disposed along the axis of rotation R from which a support arm 276 is cantilevered. In this way, both swaying and bouncing motions may be provided.

An alternative bouncer drive system is shown in FIG. 20, where elements in common with the previous embodiment are identified with like reference numerals. In this example, a shaft of the DC motor 258 has a worm 276 directly attached thereto. The worm 276 mates with a cam-gear 278 that acts as a hybrid horizontal cam and worm gear. A perimeter surface 280 of the cam-gear 278 has helical teeth to engage the worm 276. A top surface 282 of the cam-gear 278 is inclined relative to the plane of the perimeter surface 282, such that rotation of the cam-gear 282 creates the desired bouncing movement.

The cam-gear 278 is supported by a backer wheel 284 located directly under the load to prevent the cam-gear 278 from deforming. A follower wheel 286 is connected to the load shaft 264. In operation, the follower wheel 286 rides the inclined plane of the cam-gear 278, while the spring 270 removes the static component of the load and the collars 266, 268 fixedly position the drive system within a housing 288.

Figure 21:
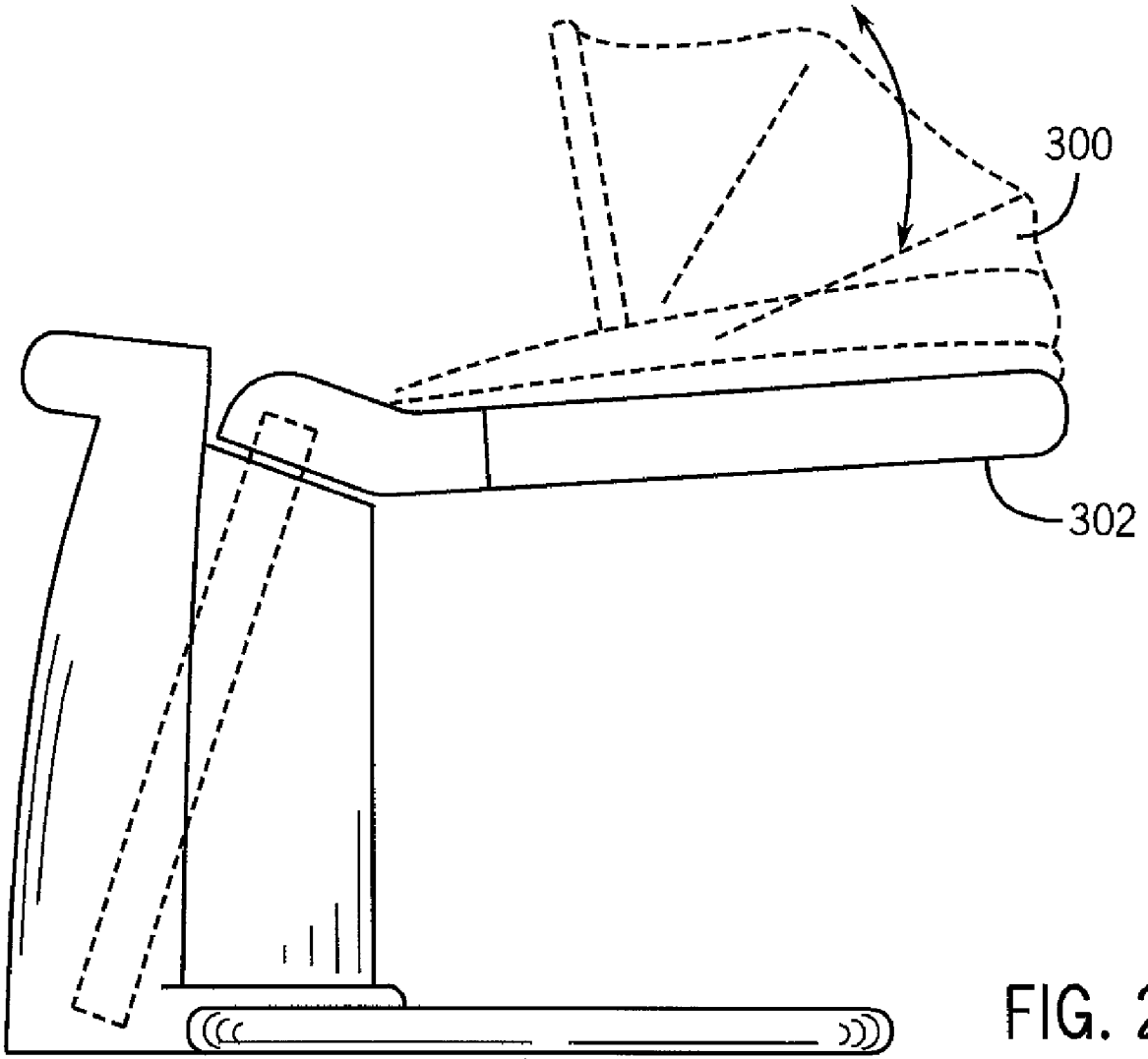
FIG. 21 is an elevational, side view of one example of a deflection-based radial oscillator drive system of a child motion device configured to provide bouncing movement in accordance with one aspect of the disclosure.

As shown in the example of FIG. 21, the bouncing motion may alternatively be provided by structures and arrangements configured for radial deflection. In these cases, a radial oscillator is generally formed by suspending the child in a seat 300 located at the end of a spring arm 302. For relatively small angular deflections, the motion seen at the end of the swing arm 302 is relatively vertical (mimicking the motion of a parent). The natural resonant frequency of this system may be calculated using the standard spring equation. A variety of drive systems may be used to maintain the resonant deflection of the spring arm 302.

Figure 22:
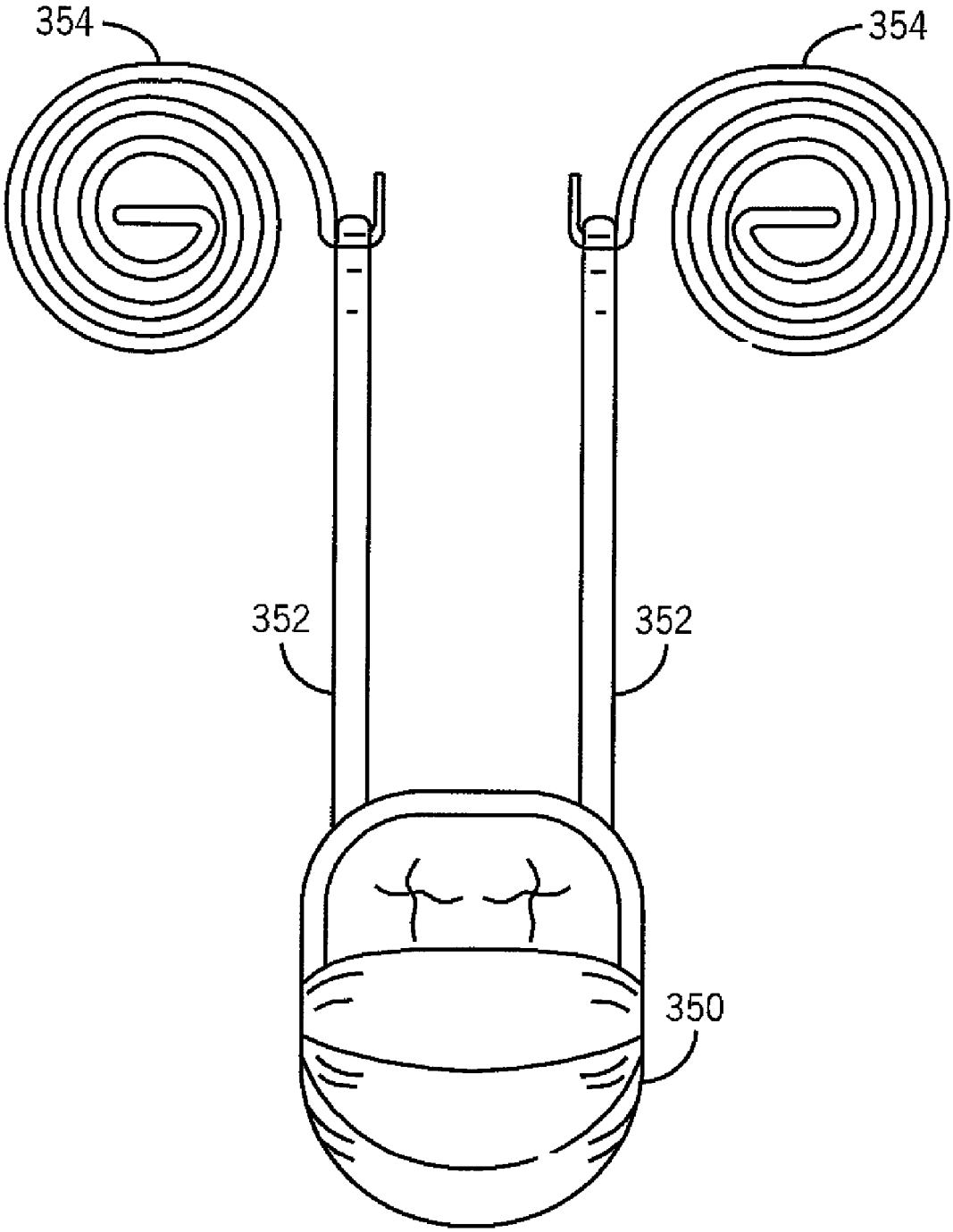
FIG. 22 is a schematic representation of a spiral spring-based drive system of a child motion device configured to provide bouncing movement in accordance with one aspect of the disclosure.

Turning to FIG. 22, an alternative design transports a seated child through a vertical bouncing motion involving the suspension of a child seat 350 from a pulley-driven cable 352. A pulley may wind/unwind the cable 352 at the predetermined, desired frequency, moving the child in a smooth up and down bouncing motion. The pulley may either be directly driven by a motor device (not shown), or driven via one or more spiral springs 354 configured to oscillate at the desired frequency. In the latter case, a drive mechanism (not shown) may be coupled to the spring arrangement to provide energy to overcome any system damping losses. Other spring-based configurations (e.g., a helical extension spring) may also be suitable for supporting the high-frequency resonant movement.

The details of the various child motion device examples disclosed herein can vary considerably and yet fall within the spirit and scope of the present invention. The construction and materials used to form the frame assembly parts, the spine parts, and the added features can vary from plastics, to steel tubing, to other suitable materials and part structures. The drive system components can also vary, as can the features employed in the drive system to create desired motions and functions for the disclosed devices. The child seat bottom or base can be configured so that it engages with the seat holder in any suitable manner. As disclosed herein, vertical or vertically angled notches can be provided in the seat base. The size of the seat holder tubes or other materials can be configured to slip into the notches to engage with the seat. Gravity and the weight of a child can be enough to retain the seat in the holder. However, positive latching structures can be employed if desired The seat can also be configured to include common features such as a harness system, carrying handles, a pivotable tray, and a hard plastic shell. The base of the seat can have a rocking, bouncing, or stationary support structure configuration and the seat can employ a pad, cover, or other suitable soft goods. As noted above, the seat holder can be configured to hold other devices such as a bassinet or other child supporting device.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device. In another example, the child seat could be fixed to the support arm and not removable.

Described above are a number of low-frequency sway devices designed to operate in a first soothing frequency range centered around about 0.5 Hz. These and other devices are also designed to act as a powered bouncer operating in a second soothing frequency range centered around about 3 Hz. The disclosed child motion devices may be configured to provide motion integrating both soothing frequencies via, for instance, simultaneous sway and bounce movements. Alternatively or additionally, the disclosed devices may be configured to provide both soothing frequencies separately. In these cases, the devices may be configured with a switch or other hardware for user selection and toggling between the various modes of operation.

Although certain child motion devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child motion device comprising:

a frame providing a structural support relative to a reference surface and comprising an arm pivotably coupled to the structural support;

a child supporting device coupled to the arm and spaced from the reference surface by the frame; and a drive system configured to move the arm such that the child supporting device reciprocates side-to-side along a motion path at a frequency within a range from about 0.37 Hz to about 0.62 Hz.

2. The child motion device of claim 1, wherein the drive system is configured to move the arm at the frequency within the range from about 0.37 Hz to about 0.62 Hz.

3. The child motion device of claim 2, wherein the drive system is configured to allow a user to adjust the frequency.

4. The child motion device of claim 1, wherein the frame is configured such that movement of the arm in accordance with the motion path has a natural resonant frequency within the range from about 0.37 Hz to about 0.62 Hz.

5. The child motion device of claim 1, wherein the frequency is within a range from about 0.4 Hz to about 0.5 Hz.

6. The child motion device of claim 1, wherein the drive system defines a generally vertical axis of rotation about which the child supporting device reciprocates, and wherein the child motion further comprises a further drive system configured to impart generally vertical oscillation along the axis of rotation.

7. A child motion device comprising:

a frame providing a structural support relative to a reference surface and comprising an arm pivotably coupled to the structural support;

a child supporting device coupled to the arm and spaced from the reference surface by the frame; and a drive system configured to move the arm such that the child supporting device reciprocates along a motion path at a frequency within a range from about 0.37 Hz to about 0.62 Hz, wherein the drive system defines a generally vertical axis of rotation, and wherein the arm is cantilevered from the axis of rotation.

8. The child motion device of claim 7, wherein the axis of rotation is offset from vertical such that the motion path has both horizontal and vertical components.

9. The child motion device of claim 8, wherein the arm has a length and an orientation relative to the axis of rotation such that movement of the arm in accordance with the motion path has a natural resonant frequency within the range from about 0.37 Hz to about 0.62 Hz.

10. A child motion device comprising:

a frame providing a structural support relative to a reference surface and comprising an arm pivotably coupled to the structural support;

a child supporting device coupled to the arm and spaced from the reference surface by the frame; and a drive system configured to move the arm such that the child supporting device reciprocates along a motion path at a frequency within a range from about 0.37 Hz to about 0.62 Hz, wherein the drive system defines a generally vertical axis of rotation, and wherein the arm is cantilevered from the axis of rotation at an acute angle.

11. A child motion device comprising:

a frame providing a structural support relative to a reference surface and comprising an arm pivotably coupled to the structural support;

a drive system configured to move the arm about a generally vertical axis of rotation from which the arm is cantilevered; and a child supporting device coupled to the arm and spaced from the reference surface by the frame;

wherein the axis of rotation is offset from vertical such that the child supporting device reciprocates along a motion path comprising both azimuthal and altitudinal changes.

12. The child motion device of claim 11, wherein the frame is configured such that movement of the arm in accordance with the motion path has a natural resonant frequency within a range from about 0.37 Hz to about 0.62 Hz.

13. The child motion device of claim 12, wherein the arm has a length and an orientation relative to the axis of rotation such that the movement of the arm in accordance with the motion path has the natural resonant frequency within the range from about 0.37 Hz to about 0.62 Hz.

14. The child motion device of claim 13, wherein the natural resonant frequency is in a range from about 0.4 Hz to about 0.5 Hz.

15. The child motion device of claim 13, wherein the axis of rotation is offset from vertical by an angle within a range from about 12 degrees to about 22 degrees.

16. The child motion device of claim 13, wherein the arm is cantilevered at an acute angle.

17. The child motion device of claim 11, wherein the drive system is configured to move the arm at a user-selected frequency.

18. The child motion device of claim 11, further comprising a further drive system configured to impart generally vertical oscillation along the axis of rotation.

19. A child motion device comprising:

a frame comprising a structural support relative to a reference surface;

a child supporting device coupled to the frame and spaced from the reference surface by the structural support; and a drive system configured to oscillate the child supporting device in a motion path at a frequency in a range from about 2.85 Hz to about 3.15 Hz.

20. The child motion device of claim 19, wherein the motion path comprises generally vertical movement.

21. The child motion device of claim 19, wherein the drive system is configured to allow user-adjustment of the frequency.

22. The child motion device of claim 19, wherein the frame comprises a spring system to support weight of a child occupant of the child supporting device to remove load from the drive system.

23. The child motion device of claim 19, wherein the frame comprises an arm cantilevered from the structural support at a pivot such that the motion path comprises deflection about the pivot.

24. The child motion device of claim 19, wherein the drive system comprises a cam.

25. The child motion device of claim 24, wherein the drive system further comprises a spring disposed between the child supporting device and the cam to offset weight of a child occupant of the child supporting device.

26. A child motion device comprising:

a frame providing a structural support relative to a reference surface and comprising an arm pivotably coupled to the structural support;

a child supporting device coupled to the arm and spaced from the reference surface by the frame; and a first drive system configured to move the arm about an axis of rotation such that the child supporting device oscillates about the axis of rotation; and a second drive system configured to oscillate the child supporting device generally along the axis of rotation.

27. The child motion device of claim 26, wherein the axis of rotation is generally vertical, and wherein the arm is cantilevered from the axis of rotation such that the child supporting device reciprocates in a swaying motion about the axis of rotation.

28. The child motion device of claim 27, wherein the axis of rotation is offset from vertical such that the swaying motion comprises both azimuthal and altitudinal changes.

29. The child motion device of claim 27, wherein the first drive system is configured to move the child supporting device such that movement about the axis of rotation is at a frequency within a range from about 0.37 Hz to about 0.62 Hz.

30. The child motion device of claim 29, wherein the frame is configured such that movement of the arm about the axis of rotation has a natural resonant frequency within the range from about 0.37 Hz to about 0.62 Hz.

31. The child motion device of claim 27, wherein the arm is cantilevered from the axis of rotation at an acute angle.

32. The child motion device of claim 26, wherein the second drive system configured to oscillate the child supporting device generally along the axis of rotation at a frequency in a range from about 2.85 Hz to about 3.15 Hz.

33. The child motion device of claim 26, wherein the frame comprises a spring system to support weight of a child occupant of the child supporting device to remove load from the second drive system.

34. The child motion device of claim 26, wherein the second drive system is configured to deflect the arm about a pivot generally along the axis of rotation.

35. The child motion device of claim 26, wherein the second drive system is configured to oscillate the child supporting device in a direction parallel to the axis of rotation.

36. The child motion device of claim 26, wherein the second drive system comprises a cam.

37. The child motion device of claim 26, wherein the first and second drive systems are configured to allow user selection of first and second frequencies at which the first and second drive systems move the child supporting device about the axis of rotation and along the axis of rotation, respectively.

38. The child motion device of claim 26, wherein the first and second drive systems are configured to allow user selection of one or both of the first and second drive systems for operation.

* * * * *

UNITED STATES PATENT AND TRADEMARK OFFICE

CERTIFICATE OF CORRECTION

PATENT NO. : 8,029,377 B2
APPLICATION NO. : 12/051468
DATED : October 4, 2011
INVENTOR(S) : Velderman et al.

It is certified that error appears in the above-identified patent and that said Letters Patent is hereby corrected as shown below:

Title Page, Item [56]
In References Cited:
U.S. Patent Documents

The following references should be added:

| | | |
|---|---|---|
| 5,833,545 | 11/1998 | Pinch |
| 2003/069079 | 04/2003 | Brian et al. |
| 2007/277309 | 12/2007 | Shane et al. |
| 2008/165016 | 07/2008 | Godiska et al. |

Title Page, Item [56]
Foreign Patent Documents

The following references should be added:

| | | |
|---|---|---|
| CN | 201 178 878 | 01/2009 |
| WO | 2008/131449 | 10/2008 |

Title Page, Item [56]
Other Publications

The following reference should be added:
Partial European Search Report issued in related EP Application No.: 10 17 1792, mailed March 22, 2011.

Signed and Sealed this
Fourteenth Day of February, 2012

David J. Kappos

David J. Kappos
*Director of the United States Patent and Trademark Office*